US007125013B2

(12) United States Patent
Sonoda et al.

(10) Patent No.: US 7,125,013 B2
(45) Date of Patent: Oct. 24, 2006

(54) AUTOMATIC FEEDING DEVICE AND RECORDING APPARATUS PROVIDED WITH SUCH AUTOMATIC FEEDING DEVICE

(75) Inventors: Shinya Sonoda, Kanagawa (JP); Nozomu Nishiberi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 253 days.

(21) Appl. No.: 10/643,698

(22) Filed: Aug. 18, 2003

(65) Prior Publication Data

US 2004/0070137 A1 Apr. 15, 2004

(30) Foreign Application Priority Data

Aug. 16, 2002 (JP) ..... 2002-237431

(51) Int. Cl.
*B65H 3/52* (2006.01)

(52) U.S. Cl. ..... 271/121; 271/117; 271/125

(58) Field of Classification Search ..... 271/121, 271/122, 124–127, 117, 118
See application file for complete search history.

(56) References Cited

U.S. PATENT DOCUMENTS 4,147,341 A * 4/1979 Wurscher et al. ..... 271/122
4,822,023 A * 4/1989 Miyoshi ..... 271/118
4,852,868 A * 8/1989 Fukui et al. ..... 271/122
4,858,907 A * 8/1989 Eisner et al. ..... 271/124
5,026,041 A * 6/1991 Kitazume et al. ..... 271/118
5,120,042 A * 6/1992 Goto et al. ..... 271/117
5,181,708 A * 1/1993 Ruch ..... 271/21
5,259,607 A * 11/1993 Hironori et al. ..... 271/10.13
5,312,098 A * 5/1994 Inoue ..... 271/122
5,470,052 A * 11/1995 Asakawa et al. ..... 271/118
5,624,109 A * 4/1997 Tanaka ..... 271/10.13
5,655,762 A * 8/1997 Yergenson ..... 271/121
5,725,208 A * 3/1998 Miyauchi ..... 271/10.09
5,918,873 A * 7/1999 Saito et al. ..... 271/10.11
5,984,297 A * 11/1999 Tanaka ..... 271/118
6,059,281 A * 5/2000 Nakamura et al. ..... 271/119
6,129,347 A * 10/2000 Brooks et al. ..... 271/22
6,260,840 B1 * 7/2001 Suga et al. ..... 271/10.12
6,305,682 B1 * 10/2001 Saito et al. ..... 271/10.11
6,318,716 B1 * 11/2001 Okuda ..... 271/121
6,378,858 B1 * 4/2002 Suga ..... 271/10.01
6,467,767 B1 * 10/2002 Yano ..... 271/122

(Continued)

FOREIGN PATENT DOCUMENTS

JP 63041335 A * 2/1988

(Continued)

*Primary Examiner*—Gene O. Crawford
*Assistant Examiner*—Matthew J. Kohner
(74) *Attorney, Agent, or Firm*—Morgan & Finnegan LLP

(57) ABSTRACT

An automatic feeding device for feeding plural number of recording sheets stacked on a pressure plate by separating them one by one is provided with a sheet-feeding roller for carrying the recording sheets stacked on the pressure plate; a separation roller for separating the recording sheets one by one by abutting against the recording sheet carried by the sheet-feeding roller; and a fornt stage-regulator that confines the number of recording sheets advancing into the separation roller. At least one of the sheet-feeding shafts provided for both ends of the sheet-feeding roller is made movable along the bearing groove of elongated hole of the bearing, and least one of the sheet-feeding shafts is structured to move between plural positions during the execution of a series of feeding operations. With the structure thus arranged, it is made possible to enable the recording medium to be bitten stably into the nipping portion of the sheet-conveying roller and pinch roller in good condition.

26 Claims, 15 Drawing Sheets

U.S. PATENT DOCUMENTS 6,536,759 B1 * 3/2003 Takada ..... 271/125
6,540,220 B1 * 4/2003 Kuo et al. ..... 271/118
6,554,270 B1 * 4/2003 Yamamoto ..... 271/117
6,585,252 B1 * 7/2003 Russo et al. ..... 271/122
6,609,707 B1 * 8/2003 Yano ..... 271/10.05
6,824,132 B1 * 11/2004 Asai et al. ..... 271/125
6,877,738 B1 * 4/2005 Sonoda et al. ..... 271/121
6,896,253 B1 * 5/2005 Hanabusa ..... 271/117
2003/0227124 A1 * 12/2003 Yun ..... 271/10.11

FOREIGN PATENT DOCUMENTS

JP 63300037 A * 12/1988

* cited by examiner

AUTOMATIC FEEDING DEVICE AND RECORDING APPARATUS PROVIDED WITH SUCH AUTOMATIC FEEDING DEVICE

BACKGROUND OF THE INVENTION

1. Field of the Invention

The present invention relates to an automatic feeding device that feeds recording medium one by one from the plural sheets thereof stacked thereon. The invention also relates to a recording apparatus provided with such automatic feeding device.

2. Related Background Art

A recording apparatus provided with an automatic feeding device performs the skew (diagonal conveyance) preventing operation, which adjusts the advancing direction of a sheet by enabling the tip of the sheet to abut against the nipping portion formed by a sheet feeding roller and a pinch roller facing it, before the recording sheet (recording medium) thus fed arrives at a recording area.

In the structure where the sheet feeding roller of a recording apparatus and an automatic feeding device are driven by use of one and the same driving source, there often adopted a structure in which a planetary arm and a planetary gear are used for switching the driving transmissions of the sheet feeding roller in order to prevent the automatic feeding device from being operated during a recording operation.

FIGS. 16A to 16D are views that schematically illustrate the skew preventing operation of the conventional automatic feeding device.

As shown in FIG. 16A, the driving gear 135, which is provided for a driving source (not shown), drives a sheet feeding roller gear 136 directly. Then, up to a sheet feeding shaft gear 119, the driving power is transmitted through an idler gear 137, a sun gear 138, and a planetary gear 139. A planetary arm 140 supports the sun gear 138 and the planetary gear 139 so as to provide the planetary gear 139 with resistance. Also, on a sheet feeding tray 116, recording sheets are stacked.

When the sheet feeding operation begins by use of a driving source (not shown), the driving gear 135 rotates in the direction indicated by an arrow P shown in FIG. 16B. Then, the sheet conveying roller 130, the idler gear 137, and the sun gear 138 rotate in the directions indicated by the respective arrows. At this juncture, for the planetary arm 140, the rotational momentum occurs in the direction indicated by an arrow Q in FIG. 16B. As a result, the planetary gear 139 is connected with the sheet-feeding shaft gear 119 to enable the sheet-feeding roller (not shown) to rotate in the direction indicated by an arrow R in FIG. 16B. At this juncture, the sheet-feeding roller and the separation roller 112, which abuts against thereto, separates and feeds the recording sheet 120 one by one.

In this state, the sheet-conveying roller 130 rotates in the direction in which the recording sheet 120 is conveyed reversely, and the sheet-feeding roller (not shown), which is connected with the sheet-feeding shaft gear 119, is caused to rotate in the direction in which the recording sheet 120 is conveyed to the recording area.

When the conveyance of the recording sheet 120 continues as it is, the leading end of the recording sheet 120 arrives at the nipping portion formed by the sheet conveying roller 130 and the pinch roller 129.

Here, the conveyance of the recording sheet 120 continues for a designated amount, and then, as shown in FIG. 16C, the leading end of the recording sheet 120 abuts against the sheet conveying roller 130 that rotates in the reverse-conveyance direction, thus forming a bend (loop) for the recording sheet 120. In this way, even if the recording sheet 120 is conveyed diagonally up to that point, it is possible to the leading end of the recording sheet 120 is placed along the nipping portion of the sheet conveying roller 130 and the pinch roller 129 to correct the advancing direction of the recording sheet 120, hence preventing the skew of the recording sheet 120.

The recording sheet 120, the preceding direction of which has been adjusted, is conveyed to the recording area by being pinched by the sheet conveying roller 130 and the pinch roller 129 as shown in FIG. 16D. At this juncture, the driving gear 135 rotates in the direction indicated by an arrow S in FIG. 16D. Therefore, the planetary arm 140 is given moment in the direction indicated by an arrow T in FIG. 16D so that the planetary gear 139 parts from the sheet feeding shaft gear 119. The structure is thus arranged so as not transmit driving power from the driving source to the sheet-feeding roller (not shown) when the nipping portion bits the recording sheet 120.

The structure of the conventional automatic sheet-feeding device described above has advantages such as to simplify the driving switching mechanism, and to control the automatic sheet-feeding device, among some others. However, only by the contact pressure of the separation roller to the sheet-feeding roller is used for generating the nip abutting force, which is needed for a recording medium to be bitten by the sheet-conveying roller. As a result, when the recording medium, which is comparatively thick or liable to slip, is fed, the abutting force becomes insufficient, and in some cases, it is disabled to bite such recording sheet into the nipping portion of the sheet-conveying roller.

SUMMARY OF THE INVENTION

Now, therefore, it is an object of the present invention to provide an automatic feeding device capable of biting recording medium stably into the nipping portion of the sheet-conveying roller and pinch roller in good condition, while keeping the structure of the device simply formed, and also, to provide a recording apparatus provided with such automatic feeding device.

In order to achieve the aforesaid object, the automatic feeding device of the present invention for feeding plural sheets of recording medium stacked on a stacking portion by separating them one by one comprises feeding means for carrying the recording medium stacked on the stacking portion; separating means for separating the recording medium one by one by abutting against the recording medium carried by the feeding means; and a front stage regulating member for confining the number of sheets of the recording medium advancing into the separating means. For this device, at least one of supporting members provided for both ends of the feeding means is made movable, and at least one of the supporting members is structured to move between plural positions during the execution of a series of feeding operations.

In accordance with the automatic feeding device of the present invention described above, recording medium abuts against the nipping portion formed between the sheet-conveying roller and pinch roller of the recording apparatus by the application of the contact force to be generated by the feeding means, and the separating means, which are in contact with the recording medium under pressure, and when the operation of adjusting the advancing direction of the recording medium (skew preventing operation) is executed, the feeding means is allowed to move in the direction in which it approaches the front stage regulating member, and then, the contact force that enables the recording medium to be in contact under pressure can also be generated between the feeding means and the front stage regulating member. Consequently, both the contact force generated by the feeding means and the separating means, and the contact force generated by the feeding means and the front stage regulating member act as forces that cause the recording medium to abut against the aforesaid nipping portion. Therefore, as compared with the case where the recording medium abuts against the nipping portion by only means of the former contact pressure, the recording medium can be bitten into the nipping portion in a better condition, and even such recording medium as a thick paper sheet or an easily slidable sheet, can be fed into the recording apparatus in good condition.

Also, it is preferable to form the structure in which the aforesaid plural positions include a first position for the feeding means to have a predetermined gap with the front stage regulating member, and a second position for the feeding means to form no gap with the front stage regulating member.

Further, it is preferable to from the structure in which the front stage regulating member is biased toward the feeding means, and to form the structure so as not to generate pressure between the front stage regulating member and the feeding means when the feeding means moves to the aforesaid second position.

With the structure thus arranged, the feeding means lies in the first position when the operation of separation, feed and conveyance is executed by the feeding means and separating means in order to generate the contact force only between the feeding means and separating means. Then, when the operation of adjusting the advancing direction of the recording medium by enabling the recording medium to abut against the nipping portion of the recording apparatus (skew preventing operation) is executed, the feeding means lies in the second position so as to make it possible to generate the contact force even between the feeding means and the front stage regulating member in addition to the aforesaid contact pressure. With the movement of the feeding means between the first position and the second position, it is made possible for the automatic feeding device to perform the operation of separation, feed, and conveyance, and that of skew prevention in good condition, respectively.

Further, the structure may be arranged to enable the feeding means to be in the first position before the initiation of feeding operation, and move in the direction toward the second position immediately after the feeding operation begins, and return to the first position during the separation of the recording medium by the separating means, and move to the second position during the operation of adjusting the advancing direction of the recording medium, and then, return to the first position when the feeding operation is completed. With the structure thus arranged, it becomes possible to perform a series of operations to separate, feed, and convey recording medium on the stacking portion, and then, to enable the recording medium to abut against the nipping portion of the recording apparatus for adjusting the advancing direction thereof in good condition.

Further, the feeding means may be structured to move in the direction substantially along straight line.

Also, it may be possible to form the feeding means by a sheet-feeding roller having a circular sightable shape on the side face, and to form the separating means by a separation roller provided with a torque limiter rotative by a predetermined torque.

Further, the structure may be formed so that the force of the feeding means to move the supporting member is generated by the relations of the vertical resistance N generated by the separating means abutting against the feeding means, the friction force F generated by the vertical resistance N between the feeding means and the recording medium, the tangential force Ft generated by the separating means, and an angle β formed by the straight line connecting the rotational center of the feeding means and the rotational center of the separating means, and the moving direction of the feeding means.

Further, it is preferable to form the structure so that the value of (1/tan β) obtainable on the basis of the angle β formed by the straight line connecting the rotational center of the feeding means and the rotational center of the separating means, and the moving direction of the feeding means is larger than the value of friction coefficient of the recording mediums themselves to be separated by the separating means. With the structure thus arranged, it becomes possible to enable the feeding means to return to the first position during the separating operation executed by the feeding means and separating means for separating recording mediums themselves in good condition.

Also, the recording apparatus of the present invention, which is provided with an automatic feeding device of the present invention described above comprises sheet-conveying means for conveying the recording medium from the automatic feeding device to the recording area; and skew preventing means for adjusting the advancing direction of the recording medium by use of the sheet-conveying means. Then, for this recording apparatus, the structure is arranged so that the sheet-conveying means, and the automatic feeding device are driven by one and the same driving source, and that the driving power is not transmitted from the driving source to the feeding means when the sheet-conveying means is driven to convey the recording medium in the direction of conveying the recording medium to the recording area, and then, the driving power is transmitted to the feeding means when the sheet-conveying means is driven in the direction of conveying the recording medium opposite to the aforesaid direction.

Since the recording apparatus of the present invention is provided with the automatic feeding device structured as described above, it is made possible to enable even such a recording medium as a thick paper sheet or an easily slidable paper sheet to be bitten into the nipping portion in good condition for the smooth performance of recording operation. Also, during the recording operation in which recording medium is conveyed to the recording area and recording is made thereon, driving power is not transmitted from the driving source to the feeding means of the automatic feeding device. The driving power is transmitted to the feeding means only when the recording operation is at rest, during which the recording medium is conveyed in the direction opposite to the aforesaid direction. As a result, it becomes possible to prevent the automatic feeding device from making any erroneous operation during the recording operation.

BRIEF DESCRIPTION OF THE DRAWINGS

FIG. 12A shows the state where the automatic feeding device is engaged in the separating operation; FIG. 12B shows the state subsequent to the completion of the skew preventing operation of a recording sheet in the recording apparatus.

DETAILED DESCRIPTION OF THE PREFERRED EMBODIMENTS

Hereinafter, with reference to the accompanying drawings, the description will be made of the embodiments in accordance with the present invention.

Figure 1:
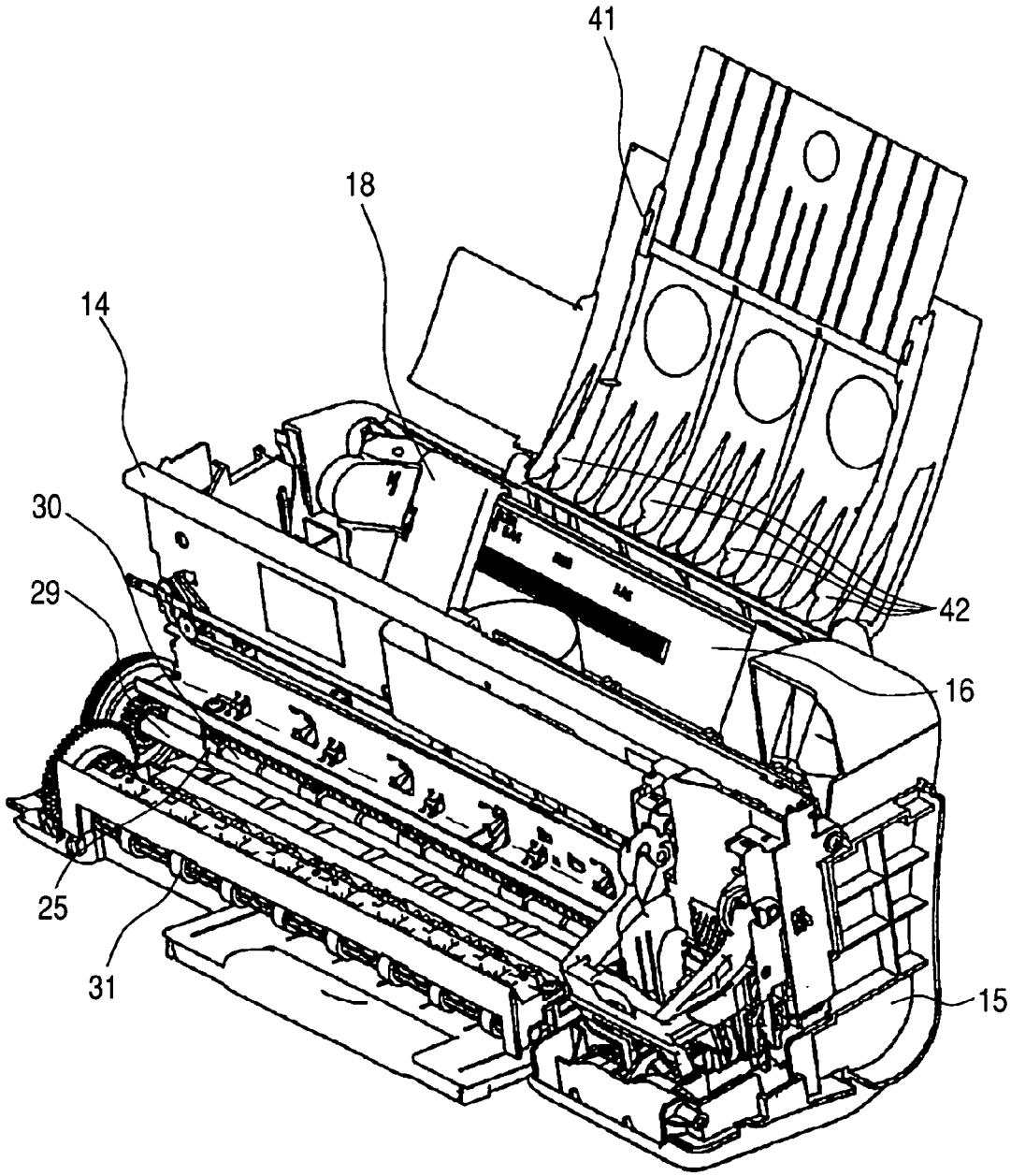
FIG. 1 is a perspective view that schematically shows one embodiment of a recording apparatus provided with the automatic feeding device to which the present invention applicable.
Figure 2:
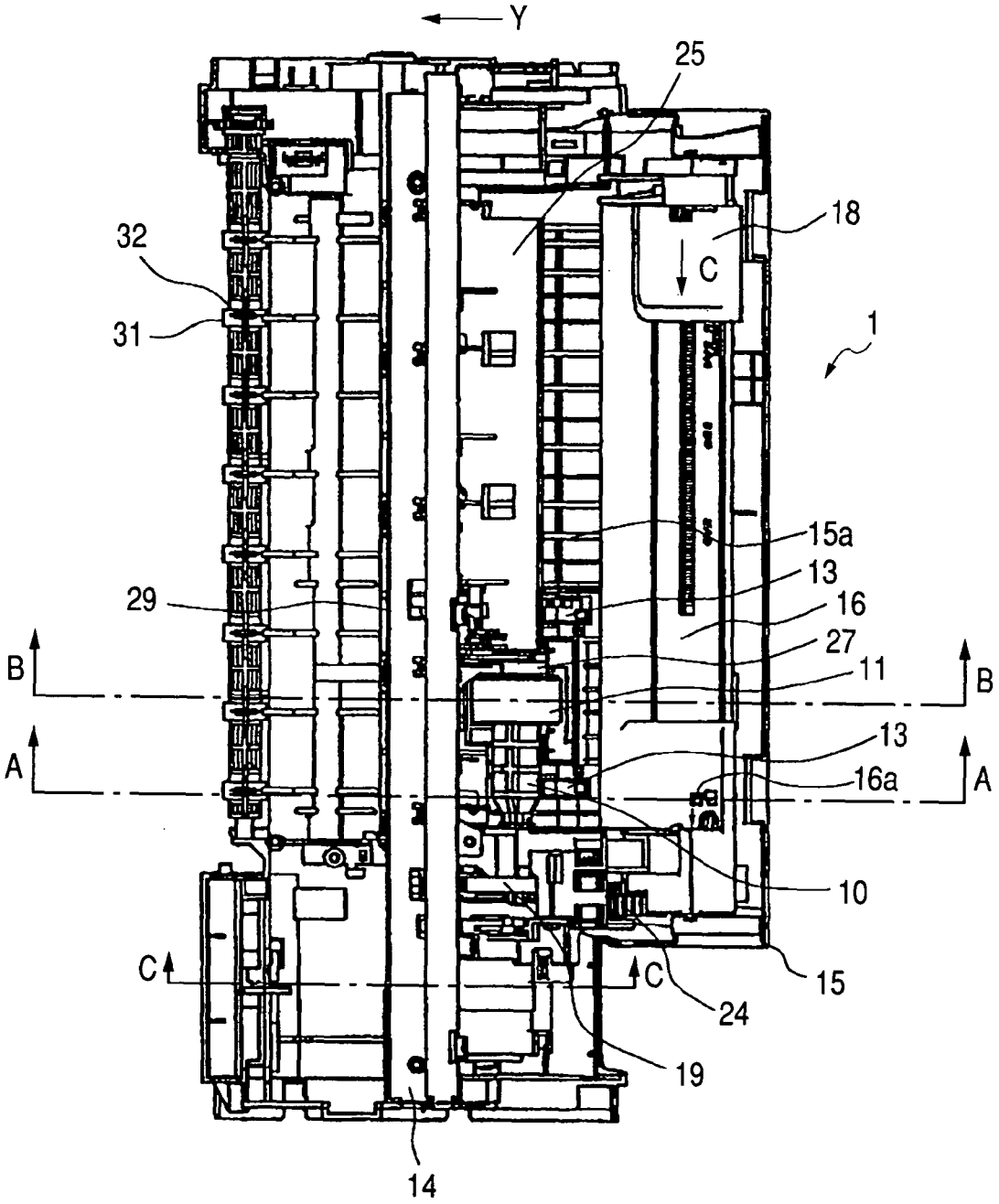
FIG. 2 is a plan view that schematically shows the automatic feeding device represented in FIG. 1.
Figure 3:
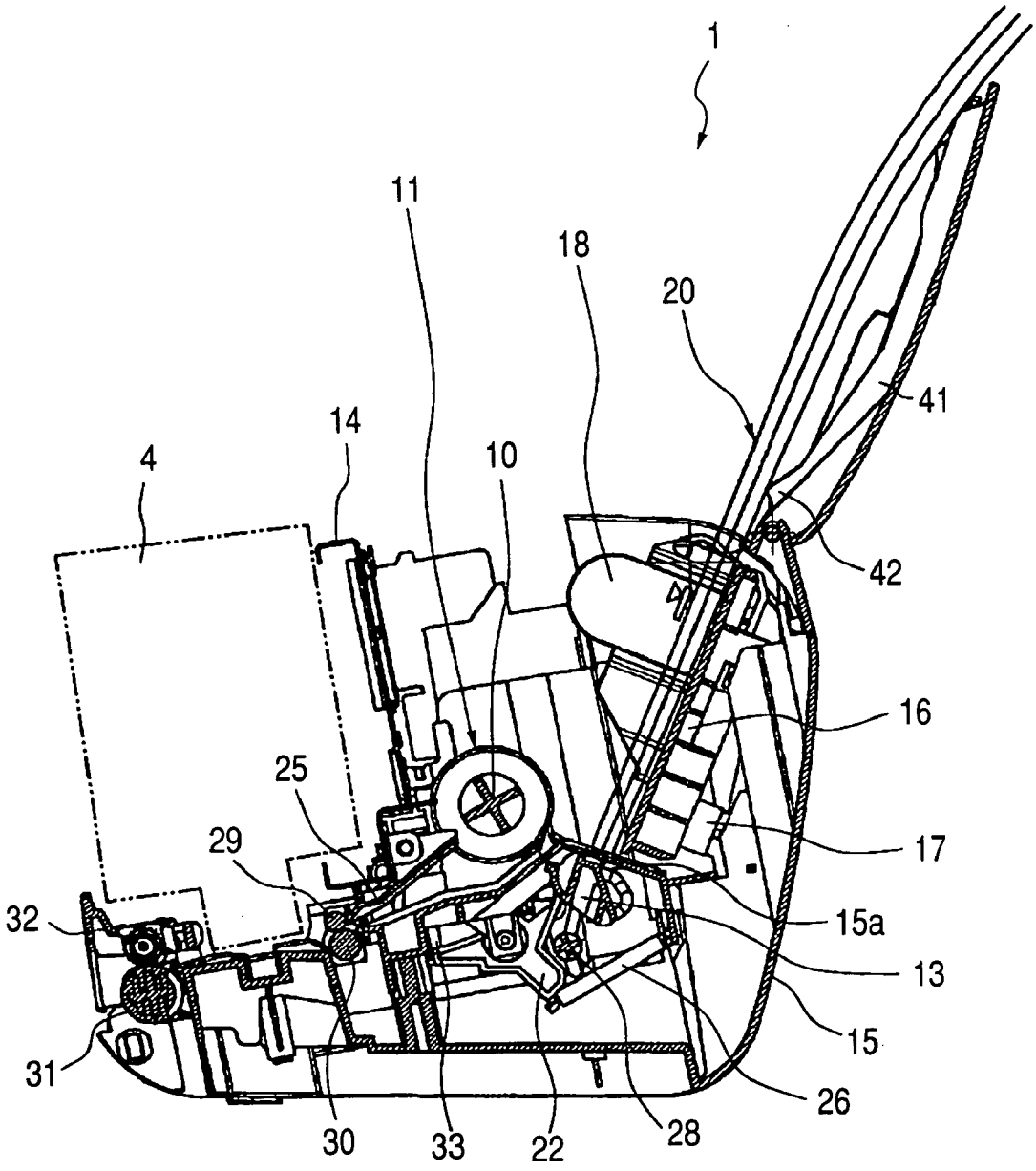
FIG. 3 is a cross-sectional view that schematically shows the section taken along line A—A in FIG. 2.
Figure 4:
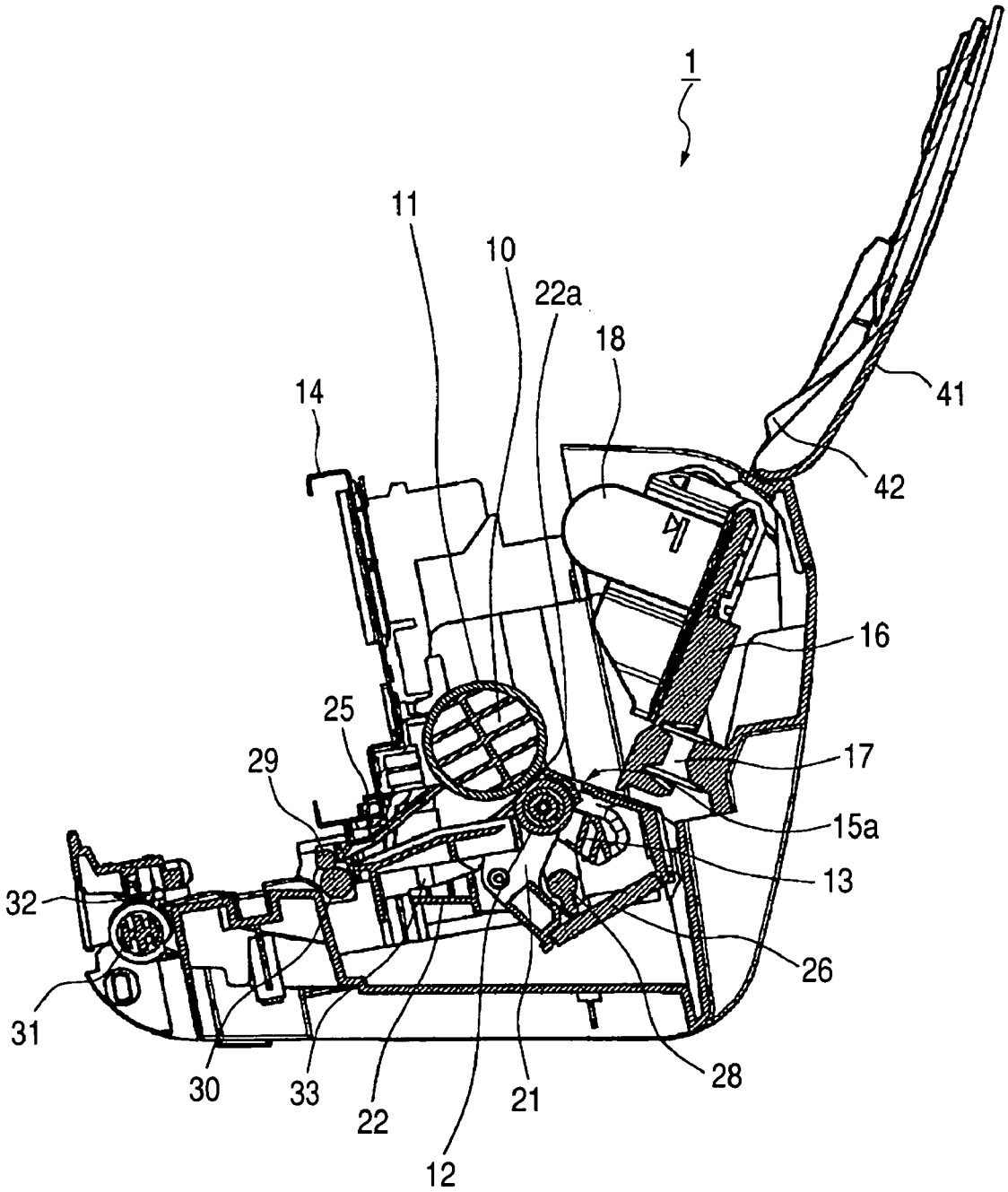
FIG. 4 is a cross-sectional view that schematically shows the section taken along line B—B in FIG. 2.
Figure 5:
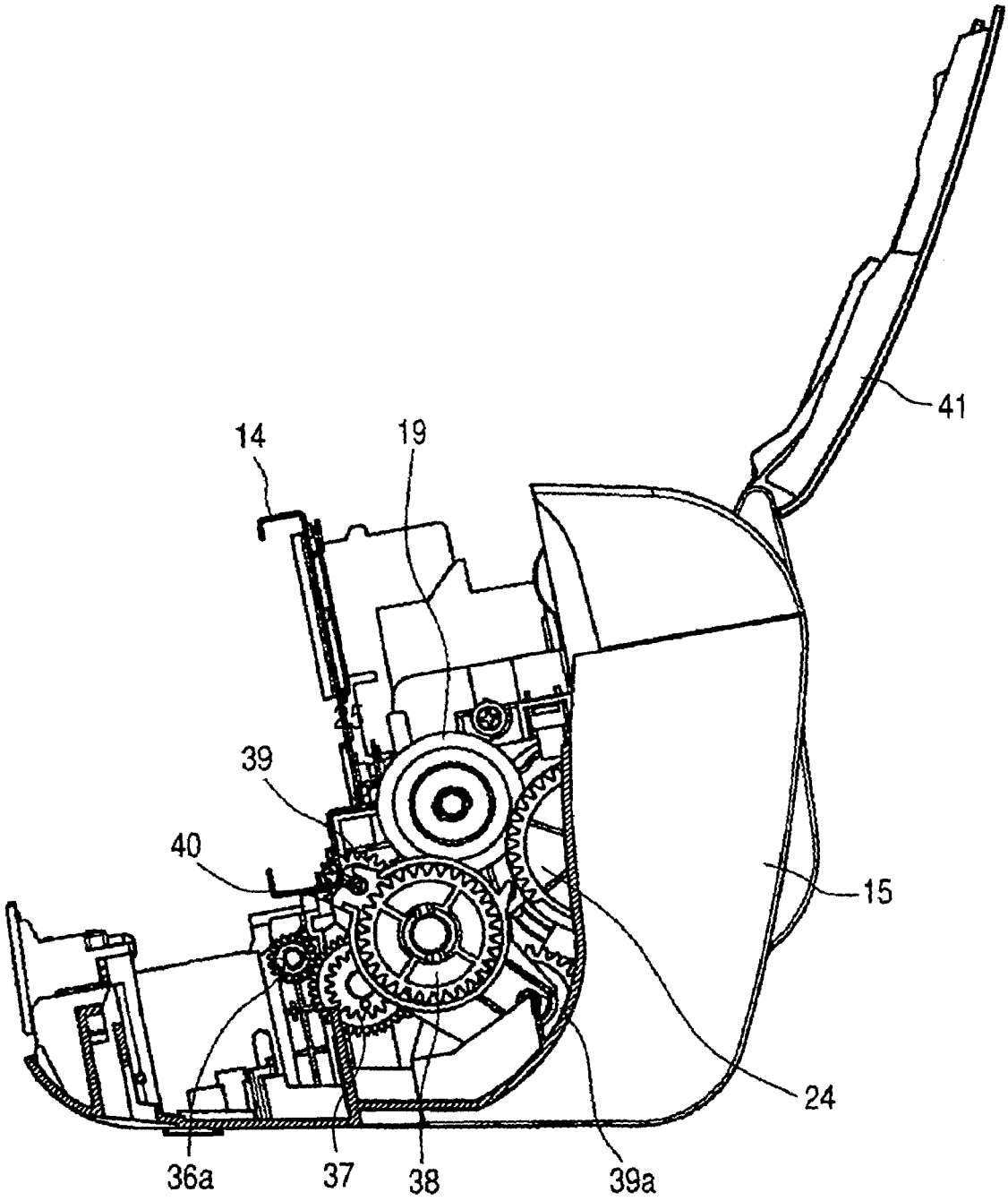
FIG. 5 is a cross-sectional view that schematically shows the section taken along line C—C in FIG. 2.
Figure 6:
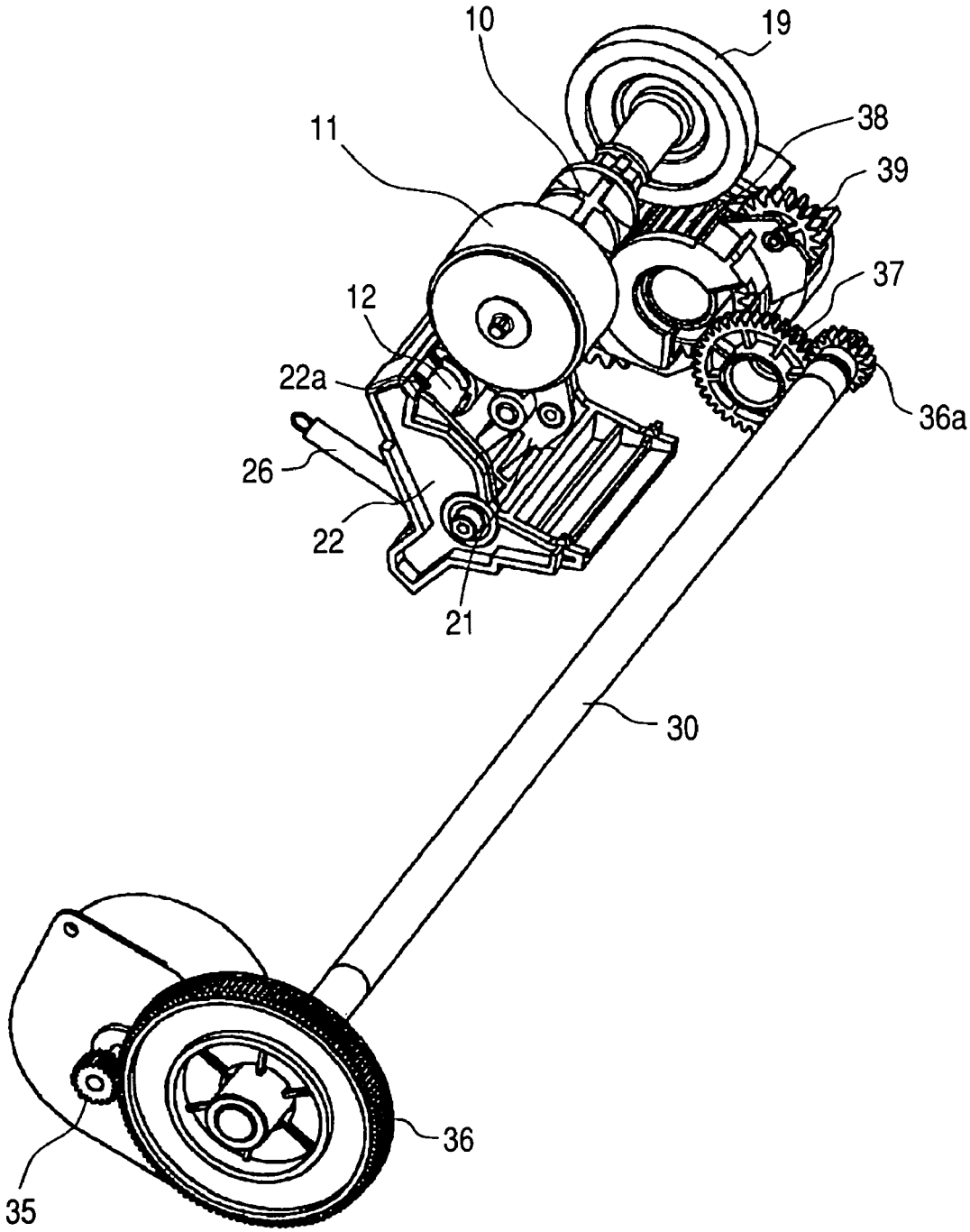
FIG. 6 is a perspective view that schematically shows the driving transmission unit of the recording apparatus represented in FIG. 1.
Figure 7A:
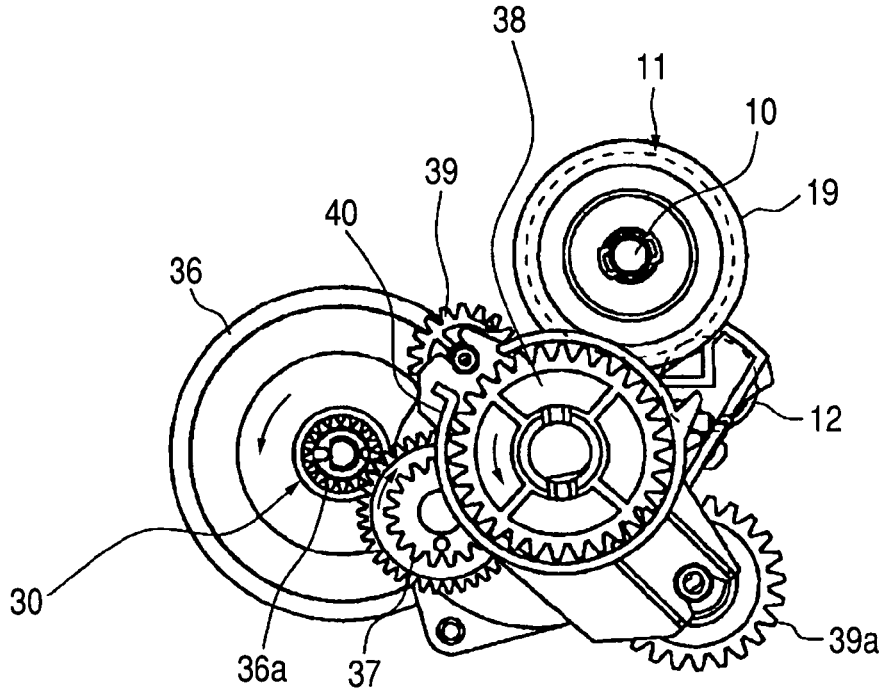
FIGS. 7A and 7B are views that illustrate the operation of the driving transmission unit of the recording apparatus represented in FIG. 1.
Figure 7B:
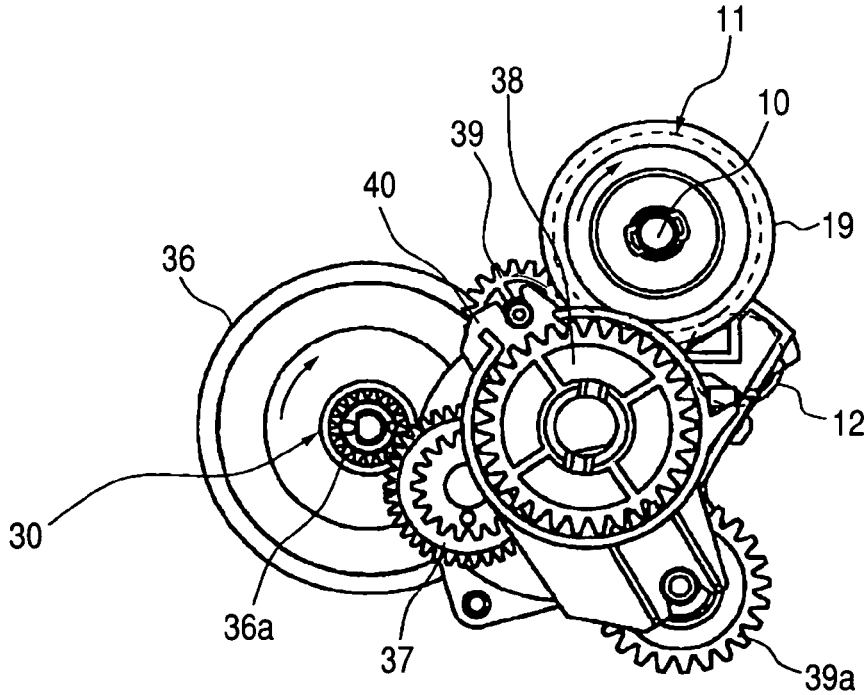

FIG. 1 is a perspective view that schematically shows one embodiment of a recording apparatus provided with the automatic feeding device to which the present invention applicable. FIG. 2 is a plan view that schematically shows the automatic feeding device represented in FIG. 1. FIG. 3 is a cross-sectional view that schematically shows the section taken along line A—A in FIG. 2. FIG. 4 is a cross-sectional view that schematically shows the section taken along line B—B in FIG. 2. FIG. 5 is a cross-sectional view that schematically shows the section taken along line C—C in FIG. 2. FIG. 6 is a perspective view that schematically shows the driving transmission unit of the recording apparatus represented in FIG. 1. FIGS. 7A and 7B are views that illustrate the operation of the driving transmission unit of the recording apparatus represented in FIG. 1.

The automatic feeding device of the present embodiment is designed on condition that it is used integrally with the other devices of the apparatus. The automatic feeding device is not provided with any driving source of its own. Therefore, this automatic feeding device is the one to be driven by the driving power transmitted from the recording apparatus side, for example.

The automatic feeding device can be roughly divided into a sheet-stacking portion; a sheeting feeding and separating portion; and a double-conveyance preventing portion. These portions are arranged and driven by the driving transmission unit provided for the recording apparatus.

(A) The driving transmission unit provided for the recording apparatus. At first, with reference to FIG. 5 and FIG. 6, the description will be made of the driving transmission unit provided for the recording apparatus. In FIG. 5 and FIG. 6, a reference numeral 30 designates a sheet conveying roller; 35, a driving gear; 36, a sheet conveying roller gear; 36*a*, a sheet conveyance output gear; 37, an idler gear; 38, a sun gear; 39, a planetary gear; 40, a planetary arm; 19, a sheet feeding shaft gear; 10, a sheet feeding shaft; and 11, a sheet feeding roller, respectively. With them, a structure is formed to transmit the driving power of the driving gear 35 from the sheet-conveying roller gear 36 to the sheet conveyance output gear 36*a*, the idler gear 37, the sun gear 38, and the planetary gear 39 through the sheet-conveying roller 30.

The aforesaid gears are connected with the driving gear 35. Here, the structure is arranged to rotate the driving gear 35 in the direction in which the recording sheet is conveyed by the sheet-conveying roller 30, and also, to rotate the driving gear 35 in the direction in which the recording sheet is reversely conveyed by the sheet-conveying roller 30.

The sun gear 38 and the planetary gear 39 are supported by the planetary arm 40 to give resistance to the planetary gear 39. Therefore, in accordance with the rotation of the sun gear 38, the planetary arm 40 rotates. By the utilization of such movements, the driving transmission from the planetary gear 39 to the sheet-feeding shaft gear 19 is switched. In other words, it is made possible to switch the transmission of the driving power and the non-transmission thereof to the sheet-feeding shaft gear 19 depending on the rotational direction of the sun gear 38.

In continuation, with reference to FIGS. 7A and 7B, the specific operation of the driving transmission unit will be described.

FIG. 7A shows the state where the driving gear 35 rotates in the sheet-conveying direction by use of the sheet-conveying roller 30. In FIG. 7A, the sun gear 38 rotates counterclockwise. Thus, the planetary arm 40 that includes the planetary gear 39 also rotates counterclockwise. The planetary gear 39 parts from the sheet-feeding shaft gear 19 and no longer transmits driving power to the sheet-feeding shaft gear 19. In other words, during the conveyance of the recording sheet by use of the sheet-conveying roller 30, driving power is not transmitted to the automatic feeding device side.

FIG. 7B shows the state where the driving gear 35 rotates in the direction in which the recording sheet is conveyed reversely by use of the sheet-conveying roller 30. In FIG. 7B, the sun gear 38 rotates clockwise, and the planetary arm 41 that includes the planetary gear 39 rotates clockwise, too. Therefore, the planetary gear 39 engages with the sheet-feeding shaft gear 19 to transmit driving power from the sheet-feeding shaft gear 19 to the sheet-feeding roller 11 through the sheet-feeding shaft 10.

As described above, in accordance with the present embodiment, the recording apparatus is structured so that only when the driving gear 35 rotates in the direction in which the sheet-conveying roller 30 conveys a recording sheet reversely, the driving power is transmitted to the automatic feeding device side.

So far, the driving transmission unit provided for the recording apparatus has been described.

(B) The sheet-stacking portion. Next, the description will be made of the structure of the sheet-stacking portion of the automatic feeding device.

As shown mainly in FIG. 1 and FIG. 2, the sheet-stacking portion is provided with a pressure plate 16; a sheet-conveyance reference portion 16*a*, which is arranged to protrude from a part of the pressure plate 16 to become the reference on one side portion of a recording sheet; and a side guide 18 that regulates the other side portion of the recording sheet. When the automatic feeding device is on the so-called standby where it does not engage in the sheet conveyance, the pressure plate 16 is fixed to a predetermined position in the direction in which it parts from the sheet-feeding roller 11. At this juncture, a sufficient gap is secured between the sheet-feeding roller 11 and the pressure plate 16 for stacking plural recording sheets.

The automatic feeding device is designed to deal with any width of recording medium within a predetermined widthwise range. Therefore, after plural recording sheets are stacked in the aforesaid gap along the sheet-conveyance reference portion 16*a*, the side guide 18 is allowed to move in the direction indicated by an arrow C in FIG. 2. In this way, the movement of the bundle of sheets thus set for stacking is likewise regulated in the direction orthogonal to the sheet-conveying direction Y shown in FIG. 2. Thus, a stable conveyance is made possible. The side guide 18 is slidably fixed to the pressure plate 16. However, in order not to allow it move unintentionally, the arrangement is made so that the guide is fixed by engaging with the latch grooves provided for the pressure plate 16. Therefore, when the side guide 18 should move, the lever portion provided for the side guide 18 is handled to release the latch.

The sheets, which are set between the aforesaid gap, are inclined to the plane of the recording apparatus. As a result, the sheets are biased downward due to the gravitation, and the leading ends thereof abut against the sheet-leading end regulating reference portion 15*a* fixedly arranged for the base 15. Here, in accordance with the present embodiment, the sheet-leading end regulating portion 15*a* is arranged in the form of ribs in order to reduce the load at the time of sheet feeding.

The rotational center of the pressure plate 16 lies on the upper end thereof, and it is made rotative around such center. Also, substantially on the extended line of the pressure plate 16, the sheet-feeding tray 41 is provided, and this sheet-feeding tray 41 is provided with a function to support the trailing end of the recording sheets thus set. One end of the sheet-feeding tray 41 is rotatively fixed to the external portion of the recording apparatus. When the recording apparatus is not used, it is possible to rotate the sheet-feeding tray 41 to fold it. For the sheet-feeding tray 41, buckling prevention ribs 42 are provided in order to prevent recording sheets to curled in the direction in which the leading end thereof is allowed to float up if thin sheets, such as plain sheets, are left intact for a long time in a state of being set on the tray.

It is arranged to regulate the movement of the pressure plate 16 by a pressure plate spring 17 (FIG. 3) and a cam (not shown), which is arranged for a control gear 24. Then, it is rotationally biased by the pressure plate spring 17 in the direction in which it approaches the sheet-feeding roller 11. It is made rotative forcefully in the direction in which it retracts from the sheet-feeding roller 11 by the cam (not shown) provided for the control gear 24 that pushes the pressure plate 16. The aforesaid movement of approach and retraction is performed at a designated timing, hence operating the sheet feeding from the automatic feeding device to the recording apparatus.

(C) The sheet feeding and separating portion. Next, the description will be made of the sheet feeding and separating portion.

By the movements of pressure plate 16 at the specific timing described earlier, the recording sheet 20 (see FIG. 3) stacked on the pressure plate 16 are pressed to the sheet-feeding roller 11. When the recording sheets 20 are pressed to the sheet-feeding roller 11, the sheet-feeding roller 11 is driven to rotate. Then, the uppermost recording sheet of those stacked, which is in contact with the sheet-feeding roller 11 by the pressure-plate 16, is conveyed by means of the friction force of the sheet-feeding roller 11. In this manner, the recording sheet is conveyed by use of the friction force of the sheet-feeding roller 11. Therefore, it is preferable to form the roller with rubber or urethane foam having high friction coefficient, such as EPDM (ethylene propylene rubber) as the material thereof.

Although the uppermost recording sheet of those stacked is conveyed by the sheet-feeding roller in this manner, the friction force between the sheet-feeding roller 11 and the uppermost recording sheet is fundamentally larger than the friction force between the uppermost recording sheet and the one immediately under it on the stack. Usually, therefore, only the uppermost recording sheet is separated and conveyed. For example, however, in a case where flash is formed for the edge portion of the recording sheet when it is seared; in a case where adhesion occurs between recording sheets due to electrostatic force; or in a case where a recording sheet having extremely large surface friction force is used, the recording sheet is not separated by use of the sheet-feeding roller 11, and plural sheets are drawn out at a time eventually. In accordance with the present embodiment, the separation roller 12 presses the sheet-feeding roller 11, as shown in FIG. 4, for the prevention of the occurrence of such case, so that the separation roller 12 is in contact with the sheet-feeding roller 11 on the downstream side of the initial contact point of the recording sheet and the sheet-feeding roller 11 in the conveying direction, thus separating only the uppermost recording sheet.

Figure 8:
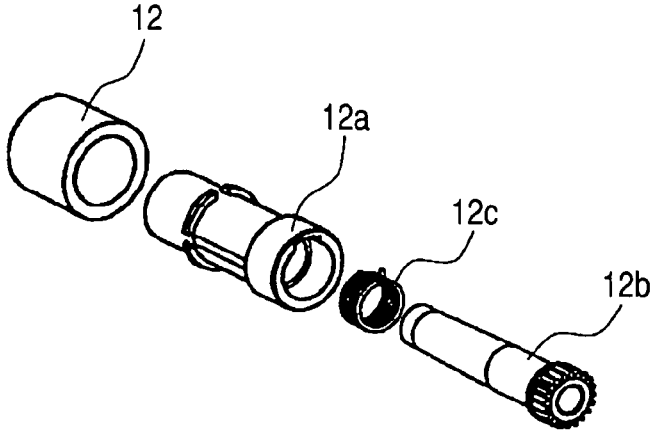
FIG. 8 is an exploded perspective view that shows the separation roller represented in FIG. 4.
Figure 9A:
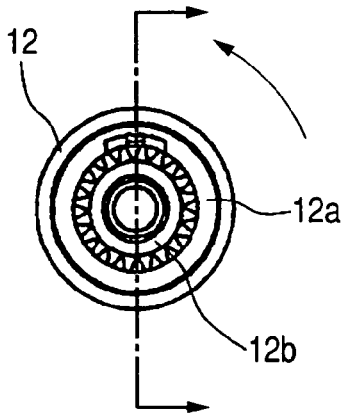
FIGS. 9A and 9B are sectional views that illustrate the separation roller shown in FIG. 4.
Figure 9B:
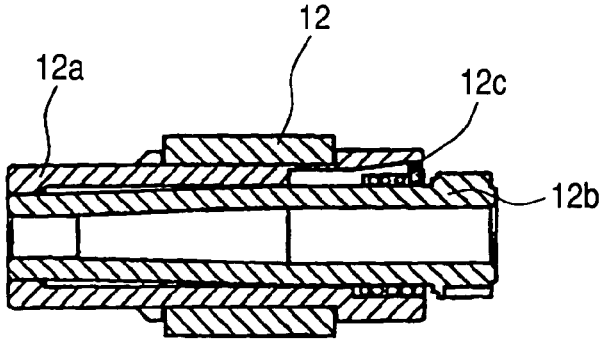

Now, with in conjunction with FIGS. 8, 9A and 9B, the description will be made of the structure of the separation roller 12. FIG. 8 is an exploded perspective view of the separation roller shown in FIG. 4. FIGS. 9A and 9B is a cross-sectional view of the separation roller shown in FIG. 4.

The separation roller 12 is fixed to a clutch cylinder 12*a*. In the clutch cylinder 12*a*, a clutch shaft 12*b* is rotatively contained. Also, a latch spring 12*c* is wound around the clutch shaft 12*b*. One winding end of the clutch spring 12*c* is hooked to the clutch cylinder 12*a*. In accordance with the present embodiment, the clutch shaft 12*b* is formed by a molded part, and a gear is integrally formed for the one end portion of the shaft 12*b*. Also, the clutch spring 12*c* is formed by a metallic coil spring.

With the structure thus arranged, when the separation roller 12 and the clutch cylinder 12*a* rotate in the direction indicated by an arrow in FIGS. 9A and 9B with the clutch shaft 12*b* being fixed, the clutch spring 12*c* wound around the clutch shaft 12*b* is released from the clutch shaft 12*b*. When the separation roller 12 and the clutch cylinder 12*a* rotate to a predetermined angle, the clutch shaft 12*b* and clutch spring 12*c* slide relatively to maintain a predetermined torque.

Rubber or urethane foam forms the surface of the separation roller 12 so as to uphold substantially the same friction coefficient as that of the sheet-feeding roller 11. A separation roller holder 21 supports the separation roller 12 through the clutch cylinder 12*a* and the clutch shaft 12*b*. A separation roller spring 26 presses the separation roller to the sheet-feeding roller 11. With the structure thus arranged, the separation roller 12 follows the rotation of the sheet-feeding roller 11 if there is no recording sheet existing between the sheet-feeding roller 11 and the separation roller 12.

When one recording sheet enters the nip between the sheet-feeding roller 11 and the separation roller 12, the friction force between the sheet-feeding roller 11 and the recording sheet is larger than the friction force between the separation roller 12, which is driven by the predetermined torque, and the recording sheet. Therefore, while the separation roller 12 being driven, the recording sheet is conveyed. However, if two recording sheets should enter the nip between the sheet feeding roller 11 and the separation roller 12, the friction force between the sheet feeding roller 11 and a recording sheet existing on the sheet-feeding roller side is larger than the friction force between recording sheets. Also, the friction force between the recording sheet existing on the torque limiter side (the separation roller 12 side) and the separation roller 12 becomes larger than the friction force between recording sheets. As a result, slip occurs between recording sheets. Thus, only the recording sheet existing on the sheet-feeding roller side is conveyed, and the recording sheet existing on the torque limiter side is caused to stop there, and is not conveyed, because the separation roller 12 does not rotate.

So far, the separation portion that uses the separation roller 12 has been described briefly.

(D) The double-conveyance preventing portion. Next, the structure of the double-conveyance preventing portion will be described.

As described above, it is possible to separate two sheets or so, which enter the nip between the sheet-feeding roller 11 and the separation roller 12, for conveyance, but if sheets of more than that enter it or if the next sheet should be fed while a sheet remains near the nip portion after two sheets have entered and only the sheet on the sheet-feeding roller side has been conveyed, a plurality of sheets is conveyed at a time. There is a possibility that the so-called double conveyance occurs. Therefore, in order to prevent this, there is arranged the double-conveyance preventing portion. A return lever 13 forms the double-conveyance preventing portion.

In accordance with the present embodiment, when recording sheets are set or recording is on standby, it is arranged to prevent the leading ends of recording sheets should unexpectedly enter deep into the automatic feeding device by advancing the return lever 13 into the recording sheet conveying passage. The return lever 13 is released after the sheet-feeding operation begins, and the structure is arranged so that it is allowed to retract from the conveyance path of the recording sheet. Therefore, the return lever 13 does not impede the advance of the recording sheet. When the separating operation is over, the return lever 13 begins operating to return the next recording sheet and on existing in the separation nip.

The return lever 13 that has finished the recording sheet returning operation rotates to the position where it retracts once from the recording sheet conveying passage, and then, the structure is arranged so that with the confirmation that the trailing end of the recording sheet has expelled from the automatic feeding device, the lever returns to the standby position again.

So far, the double-conveyance preventing portion formed by the return lever 13 has been described briefly.

Next, in conjunction with the timing chart and the cross-sectional views, which illustrate the automatic feeding device schematically, the description will be made of the operation of the sheet-feeding mechanism.

Figure 10:
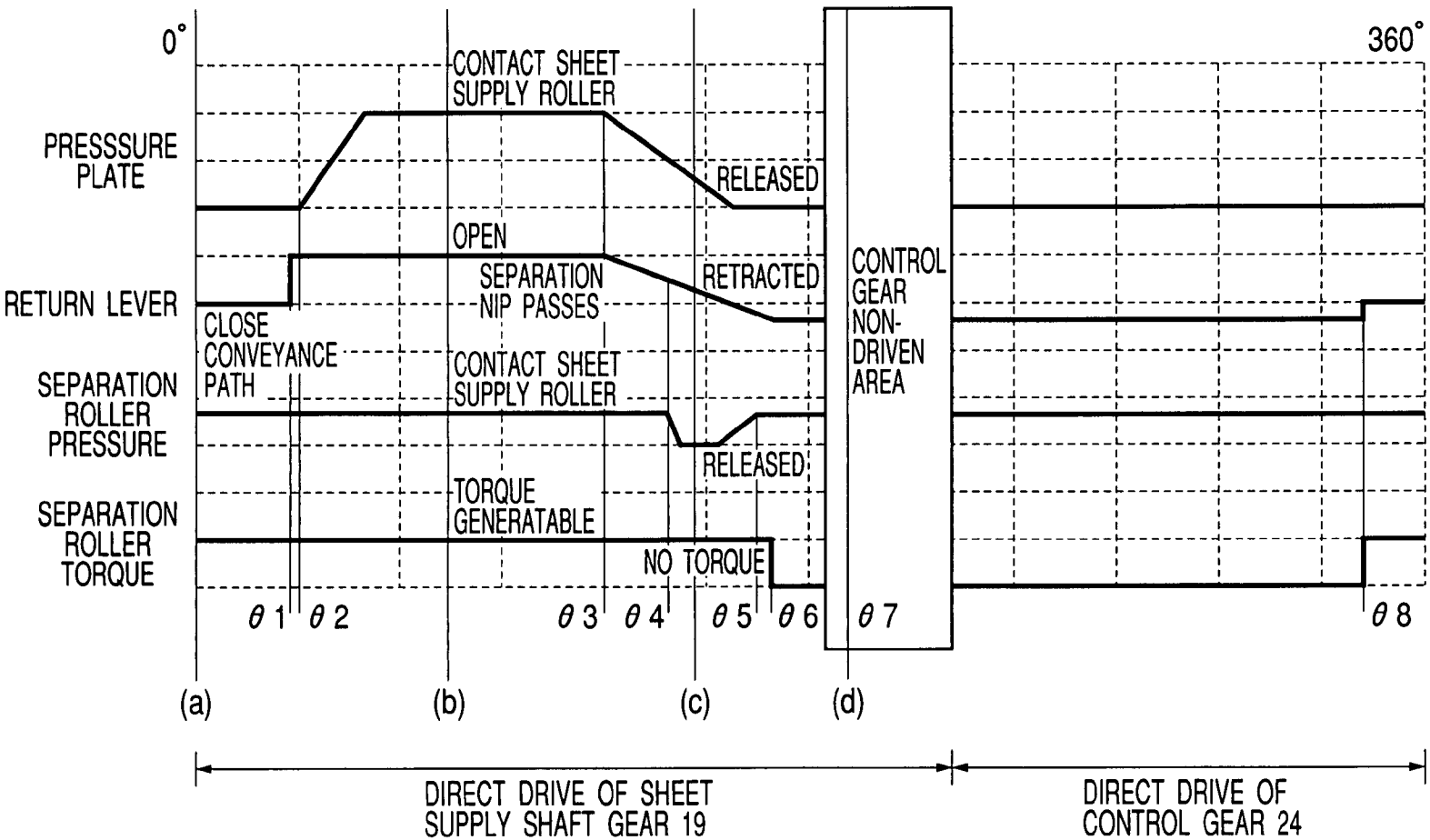
FIG. 10 is a timing chart that shows the operation of the automatic feeding device.

FIG. 10 is a timing chart that shows the movements of the automatic feeding device embodying the present invention. FIG. 10 shows the position of the pressure plate 16, the position of the return lever 13, the position of the separation roller 12, and the conditions of the torque limiter of the separation roller 12. The axis of abscissa indicates the angular phases of the control gear 24. Also, FIGS. 11A to 11D are views that illustrate each operational condition of the automatic feeding device of the present embodiment.

FIG. 10, when the angle of the control gear 24 is 0°, the automatic feeding device is in the condition shown in FIG. 11A to be described later. A series of movements begins with the standby condition of the automatic feeding device shown in FIG. 11A. Also, the driving gear train of the recording apparatus is then controlled to be in the state shown in FIG. 7A.

Figure 11A:
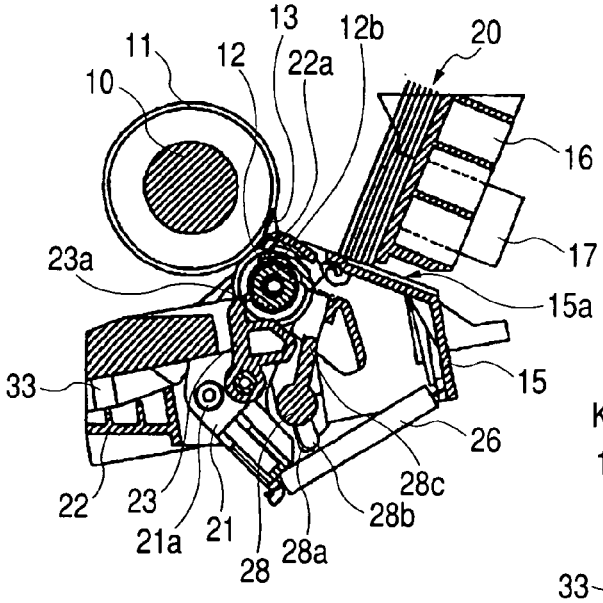
FIGS. 11A, 11B, 11C, and 11D are views that illustrate the operational conditions of the automatic feeding device, respectively.

In the standby condition, the pressure plate 16 is held in a position away from the sheet-feeding roller 11, which looks circular from the side face, as shown in FIG. 11A, and the return lever 13 advances into the recording sheet conveying passage. Then, the leading end of the recording sheet 20, which has been set, is prevented from dropping into the separating portion. The separation roller 12 is in a state of being in contact with the sheet-feeding roller 11 under pressure. The separation roller 12 is conditioned to generate torque. The state where the separation roller 12 can generate torque is formed when the leading end 23*a* of a lock lever 23 is bitten into the gear, which is provided for the end portion of the clutch shaft 12*b* as shown in FIG. 11A.

The separation roller 12 and the lock lever 23 are both fixed to the separation roller holder 21. The separation roller holder 21 is fixed to the base 15 so as to be rotative around the rotational center 21*a* as the center, and then, biased in the direction toward the sheet-feeding roller 11 by means of the separation roller spring 26. Also, a front stage regulating member holder 22 is fixed to the base 15 to be rotative around the same rotational center 21*a* as the center. The front stage regulating member holder 22 is biased by a front stage regulating member spring 33 so that a part thereof abuts against the base 15 to be positioned.

Further, a release cam 28 is provided in order to enable the lock lever 23, the separation roller holder 21, and the front stage regulating member holder 22 to be rotated, respectively. Here, the active face 28*a* of the front stage regulating member holder, the active face 28*b* of the separation roller holder, and the active face 28*c* of the lock lever form the release cam 28.

The leading end of the recording sheet 20 is supported by the recording sheet leading end reference portion 15*a* and on the standby in a state where the backside of those stacked is supported by the pressure plate 16. So far, the description has been made of the standby condition.

Next, in accordance with the angles of the control gear 24, the description will be made of the processes from the initiation of sheet feeding to the event that the recording sheet is carried over to the recording area.

The sheet feeding operation of the automatic feeding device hereof can be divided into two operations, that is, separating operation and conveying operation.

At first, the separating operation will be described.

When the sheet-conveying roller 30 rotates the driving gear 35 in the direction in which a recording sheet is reversely conveyed, the driving gear train of the recording apparatus is in the state shown in FIG. 7B. The planetary gear 39 engages with the sheet-feeding shaft gear 19 to enable the automatic feeding device to begin sheet feeding.

Figure 11B:
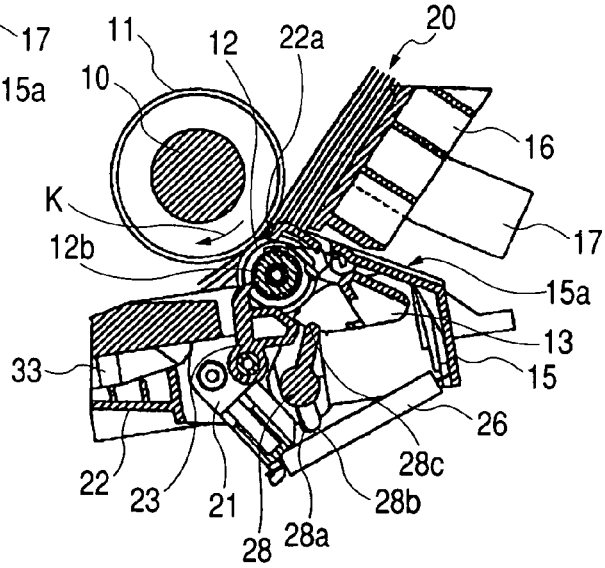

When the sheet feeding begins, the sheet-feeding roller 11 begins rotating in the direction K in FIG. 11B, and the separation roller 12 rotates along with the rotation of the sheet-feeding roller 11. As a result, the clutch spring 12*c* in the separation roller 12 is charged to a predetermined torque. Also, along with the rotation of the sheet-feeding roller 11, the control gear 24 rotates to an angle θ1 shown in FIG. 10. Then, with the action of a control cam (not shown) of the control gear 24, the return lever 13 is at first in the state of being released, thus securing the recording sheet conveying passage. Here, the driving transmission to the control gear 24 is effectuated from a driving source (not shown) through the sheet-feeding shaft gear 19.

Next, when the sheet feeding operation advances to enable the control gear 24 to rotate to an angle θ2 shown in FIG. 10, the fixation of the pressure plate 16 is released by the action of the control cam (not shown) provided for the control gear 24. Thus, the stacked recording sheets 20 begin to be pressed in the direction of the sheet-feeding roller 11 by the action of the pressure plate spring 17. When the recording sheets 20 are pressed by the sheet-feeding roller 11, the sheet conveyance begins as described earlier.

FIG. 11B shows the state of the recording sheets 20 being separated.

The uppermost recording sheet 20 of those stacked is in contact with the sheet-feeding roller 11 to begin sheet feeding. Then, by means of friction force between sheets, not only the uppermost sheet, but also, a plurality of recording sheets, which are next thereto and on, may be fed in some cases. Then, with the function of a gap formed between the front stage regulating member 22*a* provided for the front stage regulating member holder 22, and the sheet-feeding roller 11, the passage of recording sheets 20 is at first regulated to deal with several sheets. Further, when the sheet feeding continues, the recording sheets 20 arrive at the nip portion formed by the sheet-feeding roller 11 and the separation roller 12. At this juncture, the separation roller 12 is caused to rotate counterclockwise by the advance of the recording sheets 20 as shown in FIG. 11B.

As shown in FIG. 11B, the lock lever 23 bites the clutch shaft 12*b* so that the separation roller 12 is caused to rotate counterclockwise as shown in FIG. 11B. Then, the clutch cylinder 12*a* rotates, but the rotation of the clutch shaft 12*b* is blocked by means of the lock lever 23. As a result, the torque, which is needed for separation, is generated by the action of the aforesaid clutch spring 12*c*, thus separating the recording sheets 20.

Next, when the control cam 24 rotates to an angle θ3 shown in FIG. 10, the retracting movement of the pressure plate 16 begins. Thus, almost simultaneously, the operation of the return lever 13 begins for the double-conveyance prevention.

Figure 11C:
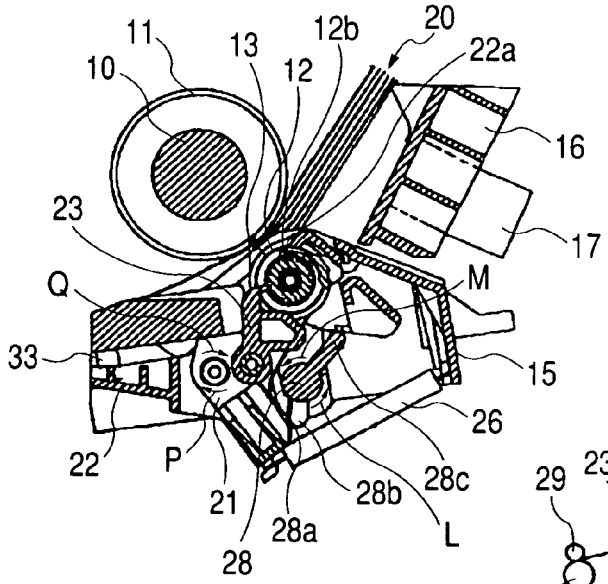

Next, when the control cam 24 advances to an angle θ4 sown in FIG. 10, the release cam 28 rotates in the direction L in FIG. 11C by the action of the control cam (not shown) provided for the control gear 24. Then, at first, the active surface 28*a* of the front stage regulating member begins to be in contact with the front stage regulating member holder 22, thus enabling the front stage regulating member holder 22 to rotate in the direction P in FIG. 11C.

Since the front stage regulating member 22*a* has regulated the entrance of the recording sheets 20 into the separating portion until then, there is some case where a plurality of recording sheets enters the gap formed by the sheet-feeding roller 11 and the front stage regulating member 22*a*, and a large force may be needed for the returning operation of recording sheets by use of the return lever 13 due to the force thus exerted by the nipping of such plurality of recording sheets. In order to eliminate this event, the automatic feeding device of the present embodiment moves the front stage regulating member 22*a* in the direction in which it parts from the sheet-feeding roller 11 to make the gap with the sheet-feeding roller 11 larger. With this operation of releasing the nipping of recording sheets, it becomes possible to reduce the force needed for the execution of the returning operation of recording sheets to follow by use of the return lever 13.

Next, by the action of the control cam (not shown) provided for the control gear 24, the leading end of the return lever 13 passes the nip of the sheet-feeding roller 11 and the separation roller 12, and the process enters the returning operation of the next recording sheet and on, which are allowed to lie in the separation nip until then.

Immediately after that, by the action of the control cam (not shown) provided for the control gear 24, the release cam 28 further rotates in the direction L in FIG. 11C, and the active face 28*b* of the separation roller holder begins to be in contact with the separation roller holder 21, thus enabling the separation roller holder 21 that includes the separation roller 12 to rotate in the direction P in FIG. 11C. In other words, when the recoding sheet returning operation is executed by the return lever 13, the regulation effect of the front stage regulating member 22*a* is released at first, and then, the separation roller holder 21 is released when the leading end of the return lever 13 passes the separation nip. Thus, in the state where all the mechanical portions that may give resistance against the returning operation are released, the returning operation is executed. As a result, the operation becomes easier by the application of a small force eventually.

Subsequently, the leading ends of all the recording sheets, with the exception of the recording sheet being fed, are conveyed in the reverse direction to the recording sheet leading end reference portion 15*a*.

Next, the sheet feeding operation advances further, and during the period in which the control gear 24 rotates to an angle θ5 shown in FIG. 10, the pressure plate 16 completes the retraction thereof from the sheet-feeding roller 11, and returns to the same position as in the standby condition. Then, when the control gear 24 rotates to the angle θ5 shown in FIG. 10, the recording sheet returning operation is almost completed, and by the action of the control cam (not shown) provided for the control gear 24, the release cam 28 rotates in the direction M in FIG. 11C. Then, by the release cam 28, the front stage regulator holder 22 and the separation roller holder 21 rotate in the direction Q in FIG. 11C, thus returning to the positions before having been released, respectively.

When the recording sheet returning operation is over, the return lever 13 further rotates and moves to the retracting position (see FIG. 11D), not to the initial standby position. With the movement of the return lever 13 to the retracting position, it becomes possible to prevent any unexpected resistance of the return lever 13 that may be in contact with the recording sheet in conveyance, thus obtaining good result of recording.

So far, the description has been made of the separating operation. In this stage, the recording sheet has not been carried over to the recording area as yet. Also, in this stage, the driving gear train of the recording apparatus is kept in the state as shown in FIG. 7B as it is.

Next, the conveying operation will be described.

Figure 11D:
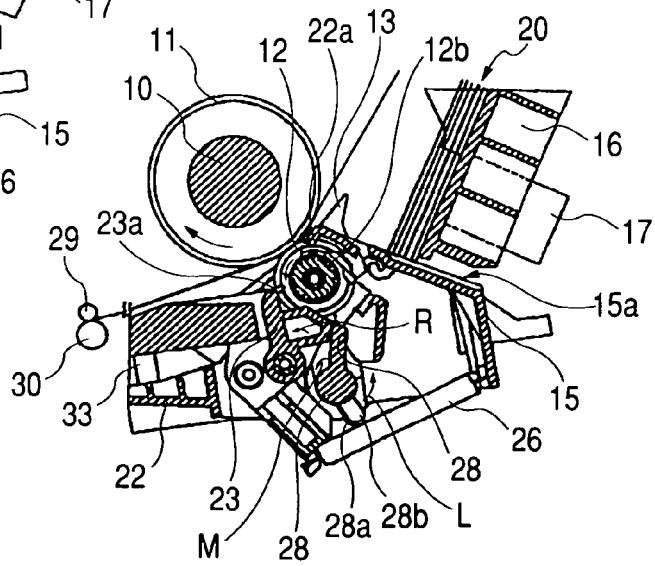

When the control gear 24 rotates to an angle θ6 shown in FIG. 10, the release cam 28 rotates in the direction M in FIG. 11D by the action of the control cam (not shown) provided for the control gear 24. Then, at first, the active face 28*c* of the lock lever is in contact with the lock lever 23 to enable the lock lever to rotate in the direction R in FIG. 11D. As a result, the leading end portion 23*a* of the lock lever 23, which has been bitten into the gear of the clutch shaft 12*b*, is disengaged from the gear, and the clutch shaft 12*b* becomes freely rotative.

When the clutch shaft 12*b* is in the state of freely rotative, there occurs no force to release the clutch spring 12*c* even if the separation roller 12 and the clutch cylinder 12*a* are caused to rotate. Therefore, the function of the torque limiter is lost, and the separation roller 12 and the sheet-feeding roller 11 rotate without any torque exerted thereon, that is, the status thereof changes into that of the so-called driven roller, respectively.

When the sheet-feeding roller 11 further rotates and the control gear 24 rotates to an angle θ7 shown in FIG. 10, the toothless portion (not shown) provided for the gear unit of the control gear 24 arrives at the position facing the sheet-feeding shaft gear 19. Thus, the sheet-feeding shaft gear 19 and the control gear 24, which are connected with the sheet-feeding shaft 10 provided with the sheet-feeding roller 11, are disengaged in accordance with the present embodiment.

Consequently, when the driving power is transmitted from the driving source to the sheet-feeding shaft gear 19, rotation is transferred to the sheet-feeding roller 11, which is connected with the sheet-feeding shift gear 19, thus making it possible to convey the recording sheet. However, no driving power is transmitted to the control gear 24. As a result, the mechanical parts, such as the return lever 13 and pressure plate 16, do not operate at all any longer. In other words, once the conveying operation takes place, it becomes possible to set the distance between the sheet-feeding portion 2 and the recording area any way, because the structure is arranged so that the recording sheet can be conveyed during the period of as long as the driving power is transmitted to the sheet-feeding, shaft gear 19, while the length of recording sheet conveyance of the automatic feeding device is virtually indefinite. Therefore, with the diameter of the sheet-feeding roller 11 being made small, it becomes possible to downsize the automatic feeding device, and to materialize the downsizing of the recording apparatus as well.

So far, the conveying operation has been described.

Figure 12A:
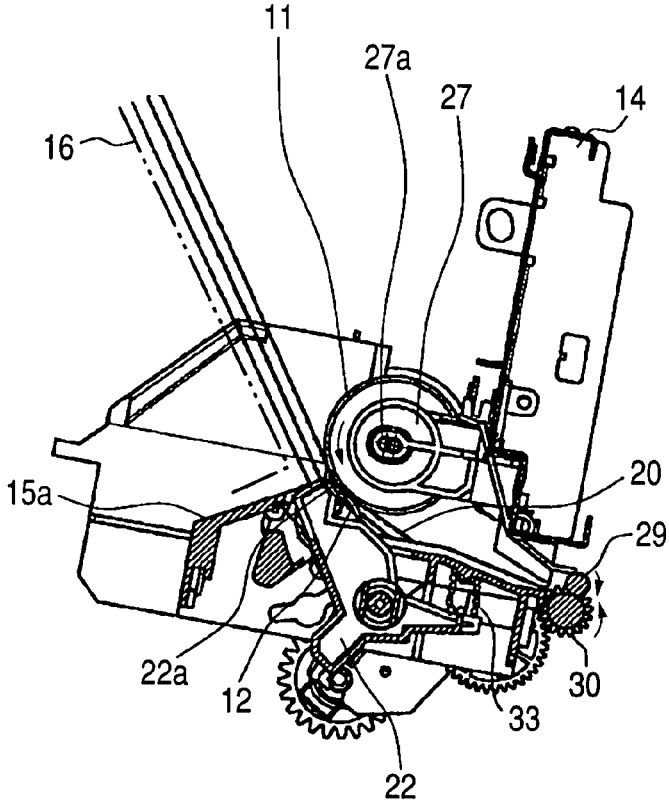
FIGS. 12A and 12B are views that illustrate the movement of the bearing of the automatic feeding device in each of the operational conditions.
Figure 12B:
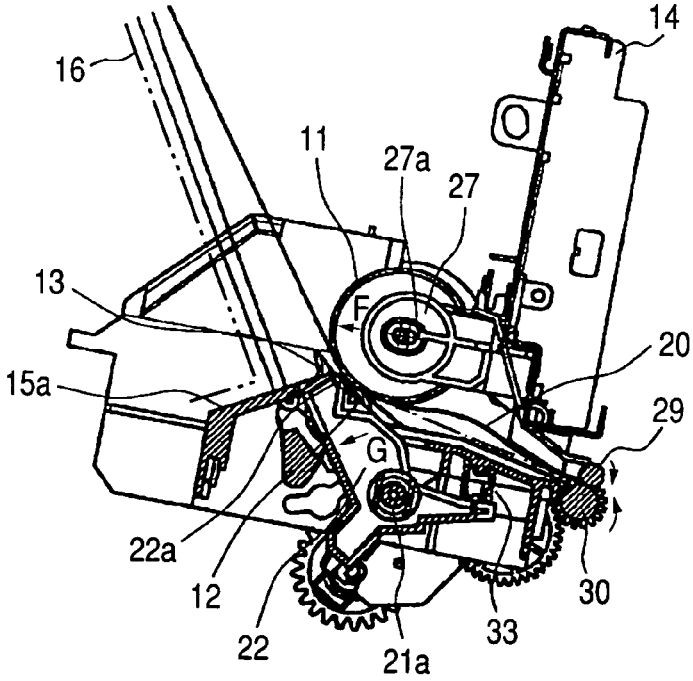

FIG. 12A shows the state of the automatic feeding device during the separating operation. FIG. 12B shows the state of the recording apparatus after the completion of skew preventing operation thereof.

When the conveying operation is continued, the leading end of the recording sheet 20 reaches the nipping portion of the pinch roller 29 and the sheet-conveying roller 30 in due course of time. The recording apparatus performs then the skew preventing operation for the recording sheet.

After the arrival of the leading end of the recording sheet 20 at the nipping portion, the conveyance of recording sheet continues further for a predetermined amount to make a bend (loop) for the recording sheet 20 (see FIG. 12B). Then, the leading end of recording sheet abuts against the sheet-conveying roller 30, which rotates in the direction of reverse conveyance, thus making it possible to place the end portion of recording sheet along the nipping portion of the sheet-conveying roller 30 and the pinch roller 20 even if the recording sheet 20 has been conveyed diagonally until then. Consequently, the advancing direction of the recording sheet 20 can be corrected, thus preventing the skew of recording sheet.

For the automatic feeding device of the present embodiment, the structure is adopted so that at least one end of the sheet-feeding roller 11 is supported by a bearing 27. Then, as shown in FIGS. 12A and 12B, the bearing 27 is provided with a bearing groove 27*a* formed in an elongated hole.

Of the bearing groove 27*a*, the center of circular portion on the right-hand side in FIGS. 12A and 12B is coaxial with the rotational center of the sheet-feeding shaft gear 19. The direction of the groove of elongated hole on the center of circular portion on the left-hand side in FIGS. 12A and 12B is positioned so as to enable the sheet-feeding shaft 10 and the sheet-feeding roller 11 to move toward the front stage regulating member 22*a*. In other words, the structure is so arranged that the one end of the sheet-feeding shaft 10, which serves as the supporting portion of the sheet-feeding roller 11, is supported by the bearing groove 27*a* of elongated hole movably in the linear direction toward the front stage regulating member 22*a*.

Now, the description will be made of the function and effect of the bearing groove 27*a* of elongated hole.

Figure 13A:
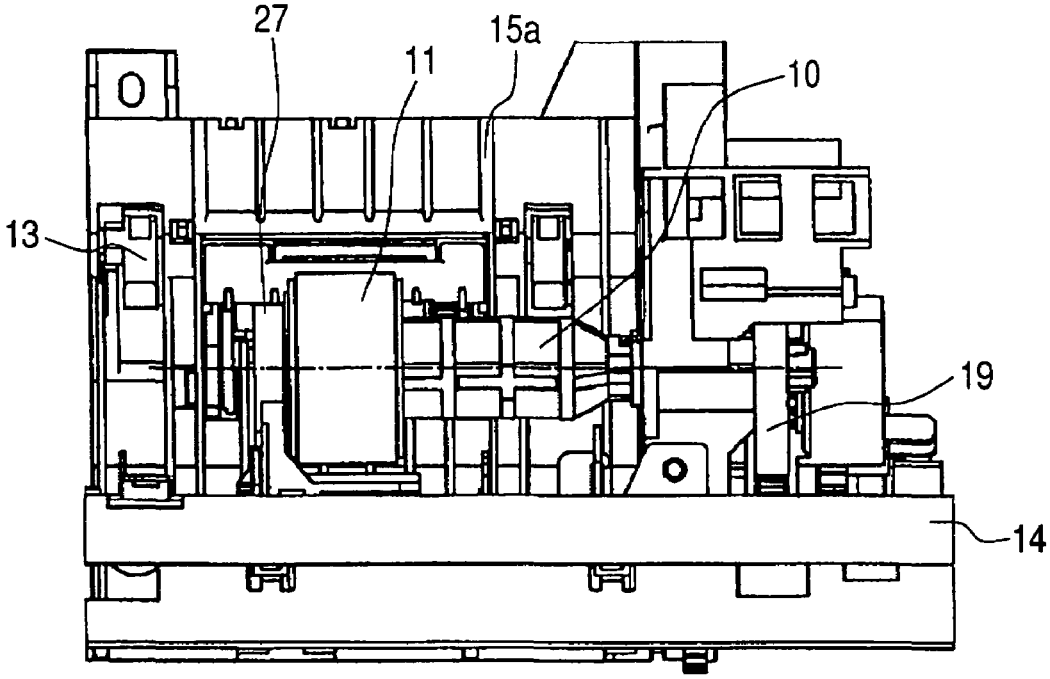
FIG. 13A is a plan view of the state shown in FIG. 12A.

As shown in FIG. 12A, the sheet-feeding shaft 10 lies on the center of the right circular portion of the bearing groove 27*a* of the elongated hole in FIG. 12A during the separating operation. FIG. 13A is a plan view that shows this condition.

In this condition, the front stage regulating member holder 22 is biased by the front stage regulating member holder spring 33 as described earlier. Here, since a part of the front stage regulating member holder 22 abuts against the base 15 to be positioned, the front stage regulating member 22*a* is positioned with a predetermined gap with the recording sheet 20, which is being separated (the position of the sheet-feeding shaft 10 at this juncture is defined as the "first position").

Figure 13B:
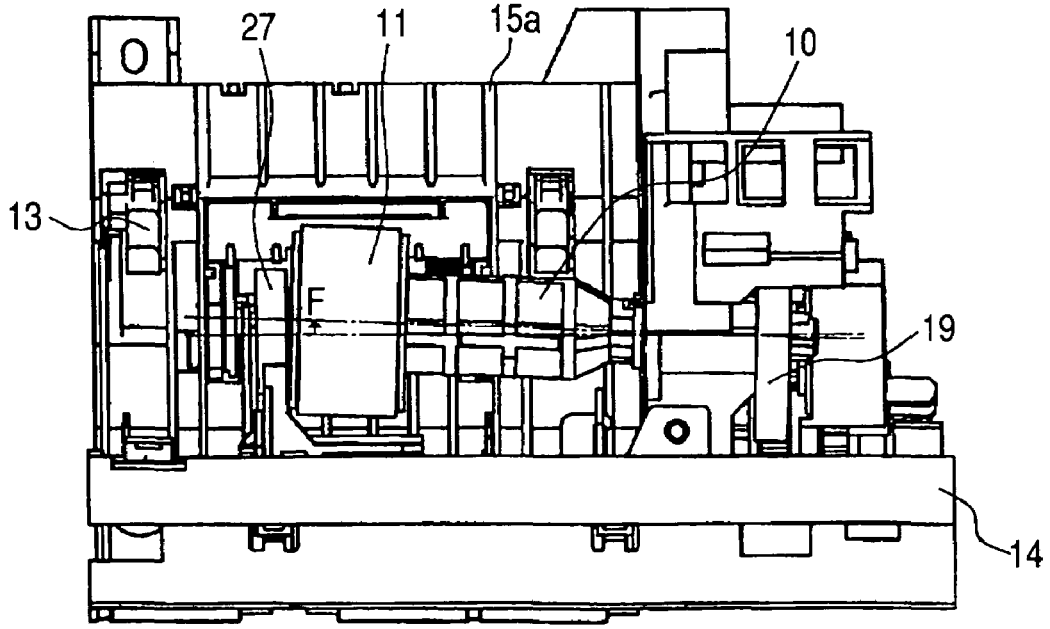
FIG. 13B is a plan view of the state shown in FIG. 12B.

Also, as shown in FIG. 12B, after the skew preventing operation, the sheet-feeding shaft 10 lies on the center of the left circular portion of the bearing groove 27*a* of the elongated hole shown in FIG. 12B (the position of the sheet-feeding shaft 10 is then defined as the "second position"). In other words, the sheet-feeding shaft 10 and the sheet-feeding roller 11 are caused by the bearing groove 27*a* of the elongated hole to be in the state of being linearly moved toward the front state-regulator 22*a* (in the direction F in FIG. 12B). FIG. 13B is a plane view that shows this condition.

As shown in FIG. 13B, it is understandable that the sheet-feeding shaft 10 is in diagonal to the axial line indicated in FIG. 13A, because the movements of the sheet-feeding shaft 10 and the sheet-feeding roller 11 are conducted only by the bearing 27 of the sheet feeding shaft 10 on one side. The bearing part of the sheet-feeding shaft 10 on the side where the sheet-feeding shaft gear 19 is installed is not in the form of the elongated hole, but there is no possibility that the rotation of the sheet-feeding shaft 10 is made uneasy even when the axial line of the sheet-feeding shaft 10 changes diagonally, because a "play" is provided for the fitting thereof.

In this respect, the example is shown, in which the movements of the sheet-feeding shaft 10 and the sheet-feeding roller 11 are conducted only by the bearing 27 on one side of the sheet-feeding shaft 10. However, it may be possible to arrange these movements to be conducted on the bearings 27 on both sides of the sheet feeding shaft 10.

When the skew preventing operation is made progress and the loop is formed on the recording sheet 20 by the rotation of the sheet-feeding roller 11, the sheet-feeding shaft 10 and the sheet-feeding roller 11 move in the direction F. Thus, the separation roller 12, which abuts against the sheet-feeding roller 11 also moves in the direction G as shown in FIG. 12B together with the separation roller holder 21. At this juncture, the front stage regulating member holder 22 is able to rotate independently from the separation roller holder 21 as described earlier, because it is installed rotatively around the same rotational center 21*a* coaxially with the separation roller holder 21. Here, the structure is arranged so that even when the separation roller 12 and the separation roller holder 21 begin to move, the aforesaid front stage regulating member holder 22 is able to keep the position as shown in FIG. 12A.

The sheet-feeding roller 11 begins to move along the bearing groove 27*a*, and when it comes beyond a certain location, the sheet-feeding roller 11 begins to press the front stage regulating member 22*a* provided the front stage regulating member holder 22 in the direction G through the recording sheet 20.

Figure 14:
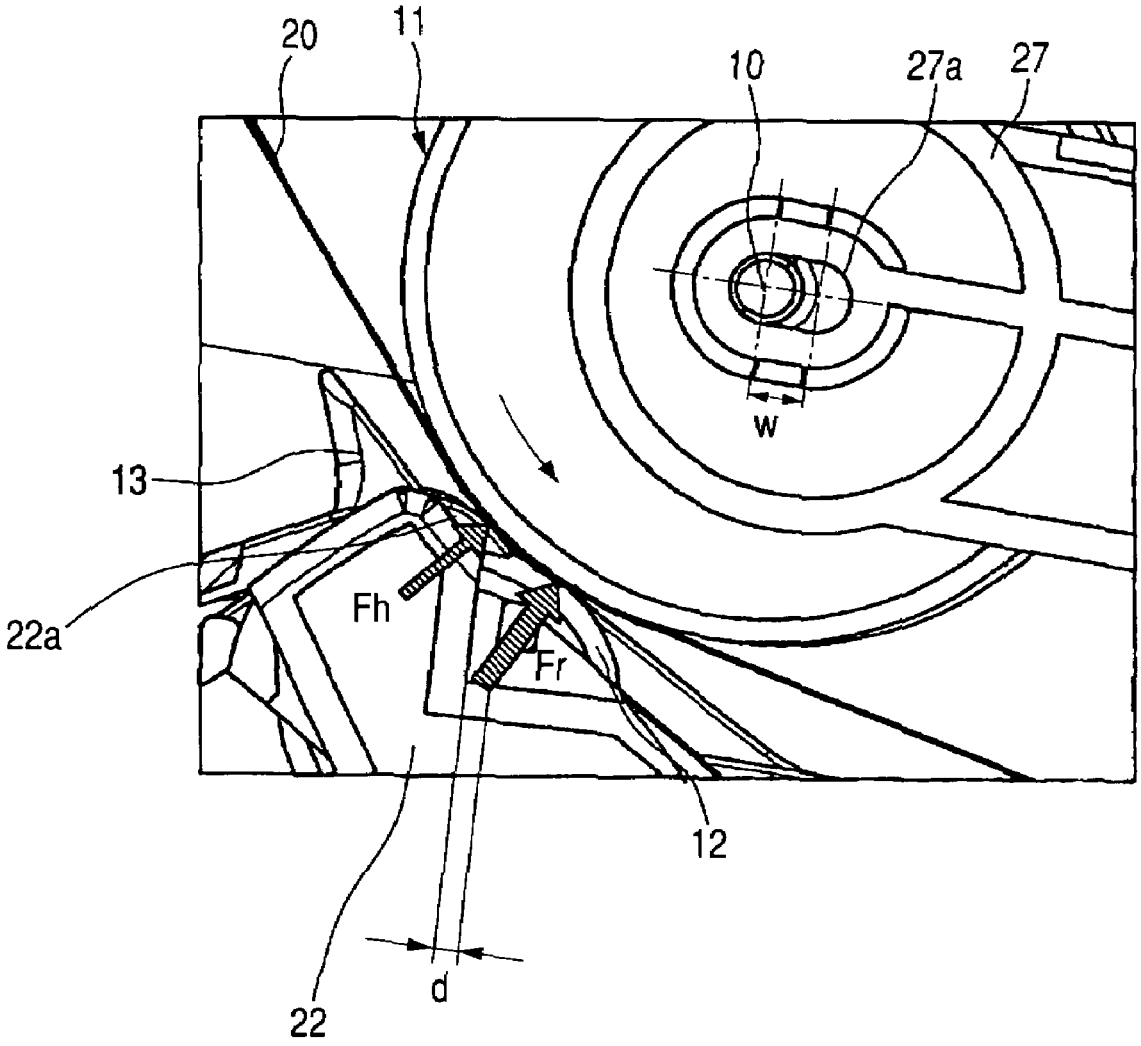
FIG. 14 is an enlarged view that shows the separating portion formed by the feeding roller and separation roller represented in FIGS. 12A and 12B.

FIG. 14 is an enlarged view that shows the separating portion formed by the sheet conveying roller and the separation roller represented in FIGS. 12A and 12B.

As shown in FIG. 14, the aforesaid operation makes progress, and when the sheet-feeding roller 11 completes the movement thereof by the length of the groove W, a gap d is formed between the front stage regulating member holder 22 and the base 15. Then, both the contact pressure Fr of the separation roller 12, and the contact pressure Fh of the front stage regulating member 22*a* are brought into the active conditions with respect to the sheet-feeding roller 11. With the two forces of Fr and Fh acting upon the sheet-feeding roller 11 through the recording sheet 20, it becomes possible to make the force stronger than the conventional structure, which presses the leading end of the recording sheet 20 to the nipping portion of the sheet-conveying roller 30.

The following table contains the actual measurement values of abutting forces against recording sheet made available by automatic sheet feeding devices of the structure (1) having the bearing the hole of which is circular without any front stage regulating member (the prior art); the structure (2) having the bearing the hole of which is elongated without any front stage regulating member; and the structure (3) having the bearing the hole of which is elongated with a front stage regulating member (the present embodiment).

TABLE 1

| | (1) Circular hole Bearing (Prior art) | (2) Elongated hole Bearing without Front stage regulating member | (3) Elongated hole Bearing with Front stage regulating member (Present embodiment |
|---|---|---|---|
| Abutting Force | 300 gf (2.94 N) | 300 gf (2.94 N) | 500 gf (4.90 N) |

From the Table 1, it is understandable that the abutting force against recording sheet obtainable by the application of the present embodiment is almost 1.6 times that of the other structures to which one and the same load conditions are given.

For the automatic feeding device of the present embodiment, it is made possible to hold the abutting force thereof against recording sheet simultaneously as understandable from the results of the principal force calculations in accordance with one example of the dynamic model to be described later. With the increase of the abutting force against recording sheet, the leading end of recording sheet 20 can be pressed reliably into the nipping portion of the pinch roller 29 and the sheet-conveying roller 30. As a result, it becomes possible to perform stably the operation of the sheet-conveying roller 30, which is executed following this, to bite the recording sheet.

In accordance with the present embodiment, when the driving gear 35 rotates in the conveying direction of recording sheet 20 by use of the sheet-conveying roller 30 immediately after the completion of the conveying operation and skew preventing operation, the leading end of the recording sheet 20 is bitten by pinch roller 29 and the sheet-conveying roller 30, and carried over to the recording area. Then, at the same time, the planetary gear 39 parts from the sheet-feeding shaft gear 19, and no driving power is transmitted to the automatic feeding device any longer as described in the item "(A) Driving transmission unit". Therefore, the driving of the sheet-feeding roller 11 terminates accordingly. In other words, when executing the biting operation for the recording sheet 20, there is no pressure being exerted by the sheet-feeding roller 11 on recording sheet. Consequently, the stability of the operation to bite the recording sheet 20 is determined by the way of pressing the leading end of the recording sheet 20 reliably into the nipping portion of the pinch roller 29 and the sheet-conveying roller 30, and also, by the way of holding such pressure thus exerted.

As described earlier, the automatic feeding device of the present embodiment is structured to perform the operation to press recording sheet 20 and hold the pressure reliably, and then, with a simple structure, it is implemented to perform an extremely stabilized operation of biting the recording sheet 20.

Figure 15:
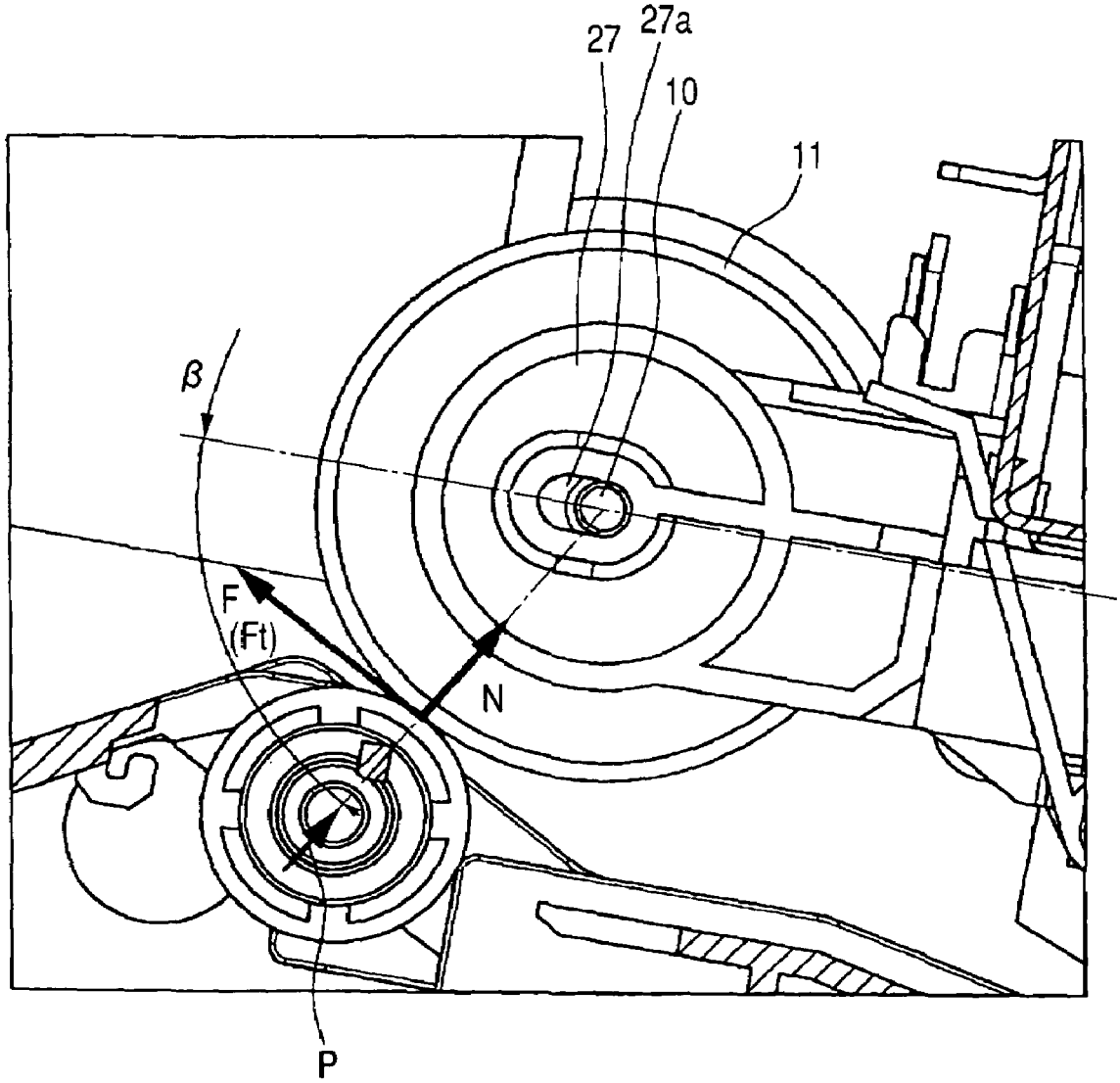
FIG. 15 is a view that shows one example of the dynamic model that illustrates the arrangement of the feeding roller and separation roller, and the main force acting thereupon, respectively.
Figure 16C:
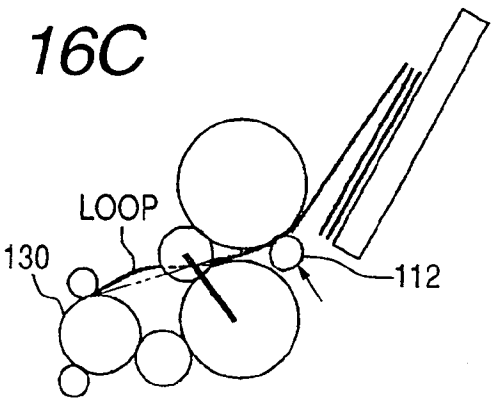
FIGS. 16A, 16B, 16C, and 16D are views that schematically illustrate the skew preventing operation by the conventional automatic feeding device.
Figure 16D:
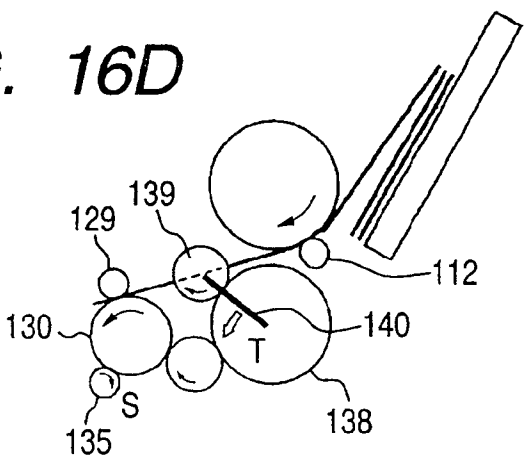
Figure 16A:
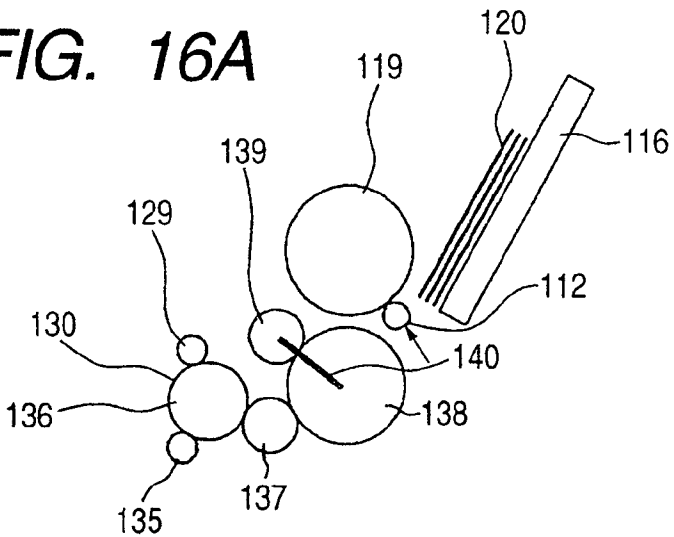
Figure 16B:
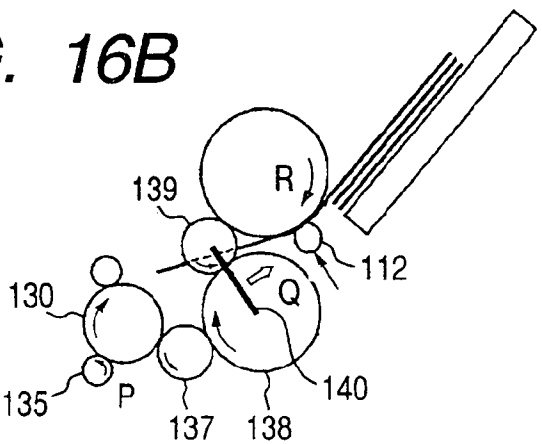

Next, using the dynamic model the description will be made of the equilibrium of forces of the sheet-feeding roller 11 and the separation roller 12 when abutting against recording sheet by the automatic feeding device of the present embodiment. FIG. 15 is a view that shows one example of the dynamic model illustrating the arrangement of the sheet-feeding roller and separation roller, and the principal forces that act thereon as well.

In FIG. 15, a reference mark P designates abutting force generated by the separation roller spring 26 (see FIGS. 11A to 11D); N, the resultant force of the abutting force P of the separation roller and the torque given to the separation roller holder 21, which is the vertical resistance exerted on the sheet-feeding roller 11; F, the stationary friction force generated by the vertical resistance N; Ft, the tangential force generated by the torque limiter of the separation roller 12, respectively. Also, a reference mark β designates the line that connects the centers of the left and right circular portions of the bearing grooves 27*a*, that is, the angle formed by the straight line that connects each of the rotational centers of the sheet-feeding roller 11 and the separation roller 12, and the direction in which the sheet-feeding shaft 10 moves linearly.

Then, it is understandable that when the vertical resistance N and the stationary friction force F or the tangential force Ft generated by the torque limiter of the separation roller 12 are converted into the component in the moving direction of the sheet-feeding shaft 10, the vertical resistance N acts in the direction in which the sheet-feeding shaft 10 should be kept to hold the position shown in FIG. 15, and on, the contrary, the stationary friction force F or the tangential force Ft generated by the torque limiter of the separation roller 12 acts in the direction in which the sheet-feeding shaft 10 should move along the groove of the bearing groove 27*a*. In other words, in accordance with the one example of the dynamic model, if the following formula should be satisfied, the sheet-feeding shaft 10 is allowed to move along the groove of the bearing groove 27*a:*

$$F \cdot \sin\beta - N \cdot \cos\beta > 0$$

or $$Ft \cdot \sin\beta - N \cdot \cos\beta > 0$$

Here, given the idle rotation torque of the torque limiter as T; the radium of the separation roller 12, as r; the dynamic friction coefficient between recording sheets, as μpp; and the dynamic friction coefficient between the sheet-feeding roller 11, and the recording sheet 20, as μgp, the F and the Ft can be obtained by the following numerical formulas:

When recording sheet is absent, and the separation roller is driven following the sheet-feeding roller:

$$Ft = T/r$$

When recording sheets are being separated (when the torque limiter is in action):

$$F = \mu pp \cdot N$$

When recording sheets abut against the sheet-conveying roller 30 (when the torque limiter is not in action)

$$F = \mu gp \cdot N$$

For the present embodiment, the vertical resistance N is approximately 300 gf (2.94N) when the torque limiter is in action. When the torque limiter is not in action, the vertical resistance N is approximately 100 gf (0.98N). The angle β is approximately 50°. The torque value T of the torque limiter of the separation roller 12 is approximately 300 g·cm (0.03 N·m), and the radius r of the separation roller 12 is approximately 7.5 mm.

On the basis of these values, the calculations of movement determination are made for the sheet feeding shaft 10 by use of the aforesaid calculation formula. The results are shown on the Table 2. Here, the dynamic friction coefficient μpp between the recording sheets is 0.7, and the dynamic friction coefficient μgp between the sheet-feeding roller 11 and the recording sheet 20 is 1.2.

TABLE 2

| | F · sinβ or Ft · sinβ | N · cosβ | Movement determination |
|---|---|---|---|
| No sheet. Separation roller is being driven | 306 gf (3.00 N) | 193 gf (1.89 N) | moves |
| Sheets are being separated | 161 gf (1.58 N) | 193 gf (1.89 N) | does not move |
| Sheets abut against the sheet-conveying roller | 92 gf (0.90 N) | 64 gf (0.63 N) | moves |

From the Table 2, it is understandable that during the operation of the automatic feeding device, if the separation roller 12 is driven following the sheet-feeding roller 11 without any recording sheet, the sheet-feeding shaft 10 moves along the groove 27*a* when the recording sheets 20 abut against the sheet-conveying roller 30. When the recording sheets 20 are being separated, the sheet-feeding shaft 10 returns to the original position (it does not move). In other words, if the calculation is made on the basis of the principal forces in accordance with the one example of dynamic model, it is found that the sheet-feeding shaft 10 moves along the groove 27*a* not only when recording sheets abut against it as described earlier, but also, it moves at the time of charging torque for the separation roller 12 immediately after the initiation of sheet feeding eventually. At this juncture, the gap between the sheet-feeding roller 11 and the front stage regulating member 22*a* becomes zero temporarily, but with the recording sheet entrance of the front stage regulating member 22*a* being chamfered, the leading end of recording sheet 20 can easily advance between them.

To describe a series of movements of the sheet-feeding shaft 10 along with the sheet-feeding operation, the sheet-feeding shaft 10 moves from the original position along the groove 27*a* immediately after the initiation of sheet feeding. Then, during the period when the separation roller 12 separates recording sheets 20, it returns to the original position. When the leading end of the recording sheet 20 abuts against the sheet-conveying roller 30, it moves again along the groove 27*a*, and then, it returns again to the original position after the biting operation is completed for the recording sheet 20. These movements are repeated. Also, it is understandable that even after the sheet-feeding shaft 10 moves along the groove 27*a*, the position thereof can be held by means of the relations between forces exerted when the leading end of recording sheet 20 abuts against the sheet-conveying roller 30.

As readily understandable from the aforesaid dynamic model, the automatic feeding device of the present embodiment makes it possible to hold the recording sheet abutting force simultaneously.

At the time of the recording sheet abutting, the sheet-feeding shaft 10 reliably moves along the groove 27*a*, and the recording sheets 20 are in separation, it is desirable that the sheet-feeding shaft 10 returns to the original position from the viewpoint of stability of the separating operation. In order to materialize this condition, the previous formulas are adjusted to enable the following formula to be established and satisfied at all times:

$$\mu pp < (1/\tan\beta) < \mu gp$$

For example, when the maximum friction coefficient μpp of the recording sheet 20, which is separable by use of the automatic feeding device of the present embodiment, is approximately 0.8, the (1/tan β) is approximately 0.84, and the friction coefficient μgp between the sheet-feeding roller 11 and the recording sheet 20 is approximately 1.2, the aforesaid formula is satisfied on the dynamic model. It is known that this is almost identical to the actual phenomenon.

So far, in accordance with one example of the dynamic model, the description has been made of the equilibrium between the forces of the sheet-feeding roller 11 and the separation roller 12 when the recording sheets abut against them.

Now, in accordance with the present embodiment, the structure is arranged so that when the sheet-feeding operation is completed, and the leading end of the recording sheet 20 is pinched into the nipping portion of the pinch roller 29 and the sheet conveying roller 30 for carrying it over to the recording area, the transmission of the driving power from the driving source to the sheet-feeding shaft gear 19 is cut off simultaneously, and then, the sheet-feeding shaft 10 and sheet-feeding roller 11 having the sheet-feeding shaft gear 19 engaged with them are enabled to rotate freely. Therefore, during the recording operation that the recording apparatus performs on the recording sheet 20, the sheet-feeding roller 11 rotates in agreement with the advance of the recording sheet 20 during the execution of recording, and there is no possibility that it drags the driving gear train. As a result, any unwanted resistance is not given to the recording sheet 20 during the execution of recording. Also, at this juncture, the separation roller 12, which is in contact with the sheet-feeding roller 11, acts as a driven roller. Therefore, the separation roller 12 does not give any unwanted load to the recording sheet during the execution of recording.

The carriage 4, which is guided by the guide rail 14 to reciprocate in the scanning direction intersecting with the recording sheet conveying direction, is arranged to hold a recording head. By the recording head held by the carriage 4 to travel in the scanning direction, images are recorded on the recording sheet 20 that has been conveyed to the recording area.

After the completion of recording operation, the recording sheet 20 is expelled outside the recording apparatus by use of a spur 32 and a sheet-expeller roller 31.

Almost at the same time of the execution of the sheet-expeller operation, the control gear 24 is rotated by the planetary gear 39*a* (see FIGS. 7A and 7B) to an angle 8 shown in FIG. 10. Then, the return lever 13 advances again into the recording sheet conveying passage so as to prevent the leading ends of recording sheets 20 from falling into the separating portion.

Also, by the action of the control cam (not shown), the release cam 28 rotates in the direction L in FIG. 11D to enable the leading end 23*a* of the lock lever 23 to bite the gear portion of the clutch shaft 12*b* again. Thus, all the mechanical portions are positioned on standby under initial condition. At this juncture, the gears of the sheet-feeding gear 19 and control gear 24 are again conditioned to be in a state of engaging with each other, hence making it possible to begin the sheet-feeding operation when the next sheet-feeding instruction is received.

As described above, the automatic feeding device of the present invention is provided with feeding means for carrying recording medium stacked on a stacker; separating means for separating recording medium one by one by abutting the recording medium thus carried by feeding means; and the front stage-regulating member, which confines the sheet numbers of recording medium advancing into separating means. Then, at least one of supporting members provided for both ends of feeding means is made movable, and at least one of the supporting members is structured to move between plural positions during the execution of a series of feeding operations, hence making it possible to enable the recording medium to be bitten into the nipping portion of the sheet-conveying roller and pinch roller of the recording apparatus in good condition, and to feed and convey even such recording medium as a thick paper or an easily slidable sheet to the recording apparatus in good condition.

What is claimed is:

1. An automatic feeding device for feeding plural sheets of a recording medium stacked on a stacking portion by separating them one by one, comprising:

feeding means for carrying said recording medium stacked on said stacking portion;

separating means for separating said recording medium one by one by abutting against said recording medium carried by said feeding means; and a front stage regulating member for confining the number of sheets of said recording medium advancing into said separating means, wherein supporting means for supporting said feeding means so that at least one end of said feeding means is movable between plural positions during the execution of a series of feeding operations, wherein said plural positions include a first position for said feeding means to have a predetermined gap with said front stage regulating member, and a second position for said feeding means to contact with said front stage regulating member.

2. An automatic feeding device according to claim 1, wherein said front stage regulating member is biased toward said feeding means by a biasing structure which is formed so as to generate pressure between said front stage regulating member and said feeding means when said feeding means moves to said second position.

3. An automatic feeding device according to claims 1 or 2, wherein a biasing structure is arranged to enable said feeding means to be in said first position before the initiation of feeding operation, and to move in the direction toward said second position immediately after the feeding operation begins, and to return to said first position during the separation of said recording medium by said separating means, and to move to said second position during the operation of adjusting the advancing direction of said recording medium, and then to return to said first position when the feeding operation is completed.

4. An automatic feeding device according to claim 1, wherein said feeding means is structured to move in the direction substantially along a straight line.

5. An automatic feeding device according to claim 1, wherein said feeding means is formed by a sheet-feeding roller having a circular shape on the side face, and said separating means is formed by a separation roller provided with a torque limiter rotative by a predetermined torque.

6. An automatic feeding device according to claim 1, wherein the force of said feeding means to move said supporting member is generated by the relations of the vertical resistance N generated by said separating means abutting against said feeding means, the friction force F generated by said vertical resistance N between said feeding means and said recording medium, the tangential force Ft generated by said separating means, and an angle β formed by the straight line connecting the rotational center of said feeding means and the rotational center of said separating means, and the moving direction of said feeding means.

7. An automatic feeding device according to claim 1, wherein the value of 1/tan β obtainable on the basis of the angle β formed by the straight line connecting the rotational center of said feeding means and the rotational center of said separating means, and the moving direction of said feeding means is larger than the value of friction coefficient of said recording mediums themselves to be separated by said separating means.

8. A recording apparatus provided with an automatic feeding device according to claim 1, comprising:

sheet-conveying means for conveying said recording medium from said automatic feeding device to the recording area; and skew preventing means for adjusting the advancing direction of said recording medium by use of said sheet-conveying means, wherein the structure is arranged to drive said sheet-conveying means and said automatic feeding device with one and the same driving source, and the driving power is not transmitted from said driving source to said feeding means when said sheet-conveying means is driven to convey said recording medium in the direction of conveying said recording medium to said recording area, and then, said driving power is transmitted to said feeding means when said sheet-conveying means is driven in the direction of conveying said recording medium opposite to said direction.

9. A feeding device comprising:

a pickup roller for carrying sheet;

a pressure plate for pressing sheet to said pickup roller;

a separation roller for separating sheet in cooperation with said pickup roller to enable said pickup roller to convey the separated sheet;

a guide member facing said pickup roller for guiding sheet advancing into the nipping portion of said pickup roller and said separation roller;

a roller pair abutting the leading end of sheet conveyed by said pickup roller for correcting the diagonal advance of the sheet; and supporting means for supporting said pickup roller to be movable to a first position having said pickup roller and said guide member to be separated, and a second position having said pickup roller to press sheet to said guide member.

10. A feeding device according to claim 9, wherein said second position is more on the upstream side than said first position in the sheet conveying direction.

11. A feeding device according to claim 9, further comprising:

a spring biasing said separation roller to said pickup roller, wherein when said pickup roller and said separation roller are separated, the biasing force of said spring enables said pickup roller to be held in said first position.

12. A feeding device according to claim 11, wherein when only one sheet is pinched between said pickup roller and said separation roller, the reaction force received by rotating pickup roller from sheet causes said pickup roller to move from said first position to said second position against the biasing force of said spring.

13. A feeding device according to claim 9, further comprising:

a torque limiter giving resistance to the rotation of said separation roller in the direction allowing sheet to advance.

14. A feeding device according to claim 13, further comprising:

a return lever for pushing back sheets other than the separated sheet to the upstream side in the conveying direction after said pickup roller and said separation roller begin the sheet separation.

15. A feeding device according to claim 14, wherein said separation roller is away from said pickup roller while the sheets are pushed back by said return lever.

16. A feeding device according to claim 15, wherein after the sheets are pushed back by said return lever, the separation roller moves to the position to pinch sheet in cooperation with said pickup roller, and the action of said torque limiter is released.

17. A recording apparatus comprising: a feeding device according to claim 8, and a carriage for holding a recording head for forming images on sheets fed by said feeding device.

18. An automatic feeding device according to claim 2, wherein a biasing structure is arranged to enable said feeding means to be in said first position before the initiation of feeding operation, and to move in the direction toward said second position immediately after the feeding operation begins, and to return to said first position during the separation of said recording medium by said separating means, and to move to said second position during the operation of adjusting the advancing direction of said recording medium, and then, to return to said first position when the feeding operation is completed.

19. A recording apparatus comprising: a feeding device according to claim 9, and a carriage for holding a recording head for forming images on sheet fed by said feeding device.

20. A recording apparatus comprising: a feeding device according to claim 10, and a carriage for holding a recording head for forming images on sheet fed by said feeding device.

21. A recording apparatus comprising: a feeding device according to claim 11, and a carriage for holding a recording head for forming images on sheet fed by said feeding device.

22. A recording apparatus comprising: a feeding device according to claim 12, and a carriage for holding a recording head for forming images on sheet fed by said feeding device.

23. A recording apparatus comprising: a feeding device according to claim 13, and a carriage for holding a recording head for forming images on sheet fed by said feeding device.

24. A recording apparatus comprising: a feeding device according to claim 14, and a carriage for holding a recording head for forming images on sheet fed by said feeding device.

25. A recording apparatus comprising: a feeding device according to claim 15, and a carriage for holding a recording head for forming images on sheet fed by said feeding device.

26. A recording apparatus comprising: a feeding device according to claim 16, and a carriage for holding a recording head for forming images on sheet fed by said feeding device.

* * * * *